US005452213A

United States Patent [19]

Ito et al.

[11] Patent Number: 5,452,213

[45] Date of Patent: Sep. 19, 1995

[54] PROCESS AND APPARATUS FOR PREPARING MIXTURE COMPRISING GRANULAR MATERIALS SUCH AS SAND, POWDER SUCH AS CEMENT AND LIQUID

[76] Inventors: Yasuro Ito, 38-16, Numabukuro 4-chome, Nakano-ku, Tokyo 165; Toshio Hirose, 43-9, Ogikubo 3-chome, Suginami-ku, Tokyo 167; Hajime Okamura, Mitsui Town House 2-E-4, 6-519, benten, Urayasu-Shi, Chiba-ken 279; Yukikazu Tsuji, 1-9-2, Hajika-cho, Ashikaga-shi, Tochigi-ken 329-41, all of Japan

[21] Appl. No.: 169,560

[22] Filed: Dec. 20, 1993

Related U.S. Application Data

[63] Continuation of Ser. No. 689,937, filed as PCT/JP89/00982, Sep. 28, 1989, published as WO 91/04837, Apr. 18, 1991, abandoned.

[51] Int. Cl.[6] ..... B28C 7/04

[52] U.S. Cl. ..... 364/468; 364/502; 366/8

[58] Field of Search ..... 364/468, 509, 510, 500–503; 366/27, 29, 16, 17–19, 43, 8, 2, 14, 152, 153, 160, 161, 162, 18, 20, 21, 141; 137/88; 222/56, 55, 77

[56] References Cited

U.S. PATENT DOCUMENTS

| | | | |
|---|---|---|---|
| 4,226,542 | 10/1980 | Black et al. | 366/18 |
| 4,335,966 | 6/1982 | Rapp et al. | 366/40 |
| 4,384,789 | 5/1983 | Ito et al. | 366/6 |
| 4,475,818 | 10/1984 | Bialkowski | 366/17 |
| 4,566,799 | 1/1986 | Ito et al. | 366/1 |
| 4,686,852 | 8/1987 | Ito et al. . | |
| 4,764,019 | 8/1988 | Kaminski et al. | 366/17 |
| 4,795,263 | 1/1989 | Kaga | 366/8 |
| 4,830,508 | 5/1989 | Higuchi et al. | 366/152 |

*Primary Examiner*—James P. Trammell

[57] ABSTRACT

When obtaining a mixture such as a mortar or a concrete by adding powder such as cement, water and other liquid to granular materials such as sand, granular slug, artificial fine aggregate, and the like, useful data can be obtained from an underwater highest density packed material which is pressure-packed under an underwater condition where the charging surface of the granular material and the liquid surface are substantially in conformity with each other. In other words, the underwater unit volume weight of the granular material under this state can be obtained, and a fluidizable fine granular quantity and an underwater loosening rate are obtained from this weight. A developed area on a flow table of the mixture and other data are obtained and when these data are employed suitably, the regulation condition of the mixture is forecast and planned with a small error to attain proper utilization.

13 Claims, 11 Drawing Sheets

PROCESS AND APPARATUS FOR PREPARING MIXTURE COMPRISING GRANULAR MATERIALS SUCH AS SAND, POWDER SUCH AS CEMENT AND LIQUID

No. 07/689,937 filed as PCT/JP89/00982, Sep. 28, 1989, published as WO 91/04837, Apr. 18, 1991, now abandoned.

TECHNICAL FIELD

The present invention relates to a process and an apparatus for preparing a mixture comprising a powder, a granular material (including a massive material) and a liquid, such as water, wherein the design of mix proportion is determined and properties of the mixture before and after hardening are predicted and controlled.

BACKGROUND ART

A composite mixture, such as a mortar or a concrete, comprising a powder, a granular material (a fine aggregate), a massive material (a coarse aggregate) and a liquid, such as water, has widely been used for various engineering work and constructions. For preparing the mixture, it is a common practice to adopt, in absolute dry condition, a water absorption, Q, according to JIS for granular and massive materials and a specific density ($\rho$SD) for a fine aggregate and to determine a design of mix proportion by a statical method in line with a given purpose. It is substantially true of the case where additives and fibrous materials are properly added.

However, as is well known, when the above-described preparation is conducted, there occur problems, such as adsorption phenomenon (or dispersion phenomenon) of the above-described powder and granule in the presence of a liquid, which makes it impossible to prepare a well-proportioned product. The above-described adsorption phenomenon (dispersion phenomenon) has an effect on the moldability or compactability, or susceptibility to bleeding or separation when an intended product is prepared through the use of the mixture, or on the strength or other properties of products after hardening of the kneaded product, as well as on the transportation and handling.

For this reason, some studies have been made on the above-described adsorption phenomenon etc. In the prior art, however, the above-described phenomenon etc. are understood merely from the theoretical and qualitative viewpoints. Under the above-described state of the art, the present inventors have previously made proposals disclosed in Japanese Patent Application No. 5216/1983 (corres. to JP, A No. 59-131164) and Japanese Patent Application No. 245233/1983 (corres. to JP, A No. 60-139407), and particularly proposed a series of method on a test for quantification of the adsorbed liquid on the surface of the fine aggregate used for the concrete or mortar, or on the preparation of a kneaded product wherein the test results are utilized. Specifically, in the above-described prior art, observation is made on the above-described liquid, such as water attached to the surface of the grain or powder, through classification into (a) one retained through a capillary phenomenon between particulate materials and (b) one adsorbed on the surface of particulate materials. In particular, an attempt has been made on the quantitative determination of the latter. Further, it is possible to efficiently conduct measurements of a plurality of samples under the same centrifugal condition, which enables the liquid components desultorily understood and grasped as the same liquid in the art to be each understood through classification and further the results of measurements to be quantified according to the respective conditions, so that a marked improvement in the kneading and preparation can be attained.

The amount or percentage of water absorbed in the fine aggregate in preparing the above-described mixture has hitherto been taken into consideration to some extent and prescribed also in JIS A1109 as a percentage of water absorption Q through the use of an equation.

In such a mixture, the fluidity apparently has an important effect on the moldability or compactability, and regarding the measurement of the fluidity, the measurement of the flow value is prescribed in JIS R5201 as a physical testing method for cement. Specifically, the fluidity of the above-described mixture is determined as its developed diameter on a flow table.

The above-described conventional general technique relates to a fine aggregate as specified in JIS, and though the liquid components of the above-described kneaded product or the like are evaluated and controlled through the use of measured values, such as percentage of water absorption, finess modulus and solid volume percentage, in a saturated surface-dry condition, physical properties of a specific kneaded product cannot properly be evaluated and controlled. Specifically, as is well known, for the above-described kneaded product, it is necessary to have information on properties such as susceptibility to separation and bleeding or workability, pumpability and compactibility. The above-described properties of the resultant mixture vary even when the water to cement ratio and sand to cement ratio are the same. In order to solidly pack and mold the kneaded product, it is a common practice to conduct a consolidation treatment such as vibration. In most cases, the behavior and change which the kneaded products show during the vibration or other consolidation treatment are remarkably different from each other even when the same measured values are obtained by the method prescribed in JIS. The properties of a ready-mixed concrete or mortar varies when a concrete is placed in a large thickness, or in a vertical form work a concrete is placed and packed therein.

The present inventors have proposed an advantageous method which comprises dividing mixing water for kneading, uniformly adhering part of the mixing water in a particular amount range to a fine aggregate, adding cement thereto for primary kneading, and adding the remaining water for secondary kneading, thereby preparing a mixture less susceptible to bleeding and separation and having excellent workability and capable of considerably enhancing the strength and other properties under the same mix proportion. This method had enjoyed a good reputation in the industry. However, even when the above-described method is employed, the degree of the above-described various effects on the resultant kneaded product vary if the fine aggregate is different.

The above-described prior art method proposed by the present inventors for the purpose of solving the above-described problem is very useful because not only is the liquid component classified into one adsorbed on the surface of the particle and one not adsorbed on the surface of the particle but also the adsorbed liquid is quantitatively determined. However, detailed studies on the data wherein specific measurements are made on the above-described technique and concrete and mortar are prepared based on the results have revealed that there is a tendency that the expected properties for the mortar and concrete cannot be obtained precisely. Specifically, according to the experimental results, it is not easy to ensure the control of the mutual intervention between an aggregate, such as a fine aggregate, and a powder (compatibility between the aggregate and the cement) and the aggregate (including a fine aggregate). It is expected that the surface roughness, shape, water retainability, of these materials, i.e., qualities of the aggregate unable to be elucidated by the conventional method prescribed in JIS greatly take part in the susceptibility to separation and bleeding, workability, pumpability and compactability of the concrete and mortar. In the above-described method, such a relationship cannot properly be elucidated, and a kneaded product cannot be efficiently prepared.

Accordingly, in practice, as is described in various literature on the execution of work of concrete etc., trial mixing is repeated to determine the most advantageously mixing-kneading condition possible. However, the trial mixing needs a considerable number of steps and time. For example, when determination of conditions including the strength of the resultant product is intended, it generally takes a period of time as long as four weeks. Therefore, when the trial mixing and test are repeated, a remarkably long period of time is spent, which renders this method unsuitable for actual execution of work. This forces the whole to be fundamentally estimated from the trial mixing etc. through experience or perception of individual workers, or tests of items capable of obtaining the results in a relatively short period of time. This lacks the rationality and cannot provide a proper consistency, which make it necessary to expect a considerably wide error range. The percentage of water absorption prescribed in JIS has some grounds to rely on, and specific amount of mixing water or the like is determined by taking the percentage of water absorption into consideration. However, as is well known in the art, the conventional method wherein the conventional percentage of water absorption prescribed in JIS is substracted or added to determine the amount of mixing water does not always provide a kneaded product or final product having predetermined properties. In the art, the occurrence of such a variation is understood as an unavoidable phenomenon caused by the adoption of the naturally obtained sand etc.

It is a matter of course that the flow value for measuring the fluidity or moldability of the mixture has some grounds to rely on. However, it is difficult to elucidate the value obtained by the development diameter of a kneaded product on a flow table. For example, even when the relationship with the water to cement ratio being an apparent deciding factor of the flow value is diagramed, no curve can be obtained on a rectangular coordinate, so that it is very difficult to conduct an analysis based on the results.

DISCLOSURE OF INVENTION

In the present invention, the weight per unit volume of an underwater closest packed material closely packed under such an underwater condition that the charging surface of the granular material is allowed to substantially coincide with the liquid surface, becomes the largest value as compared with other weight per unit volumes in such a mixture, and the underwater weight per unit volume is expected to be a value closest to placed and packed state of the actual mortar or concrete and represents such a placed and packed state. Specifically, it is possible to determine proper properties or characteristics through determination of production conditions of the mixture by making use of the underwater weight per unit volume as an index.

It is estimated that the difference between the underwater weight per unit volume and the weight per unit volume in absolute dry condition is attributable to the fact that flowable particulates present in the granular materials have been packed between the granular materials under the above-described underwater condition. The amount of the flowable particulate has a proper correlation with the water to cement ratio (wherein included air is determined as water) etc.

The percentage of underwater loosening determined based on the above-described underwater weight per unit volume as well becomes a proper measure for an actual packed and placed material.

Each percentage of residual liquid after allowing a drainage energy to act on a plurality of mixtures comprising a powder, such as cement, and a granular material having varied specific surface area, i.e., varied particle size distribution, followed by draining treatment until there occurs substantially no lowering of the liquid content even in the case of an increase of the drainage energy is obtained as a percentage of relative critical adsorbed water which varies proportionally with a change in the specific surface area of the granular material, and the intersection of a straight line formed by the percentage of relative critical adsorbed water in a diagram of rectangular coordinates expressed in terms of the relationship with the above-described specific surface area and the percentage of residual liquid, and the zero axis of the specific surface area is a percentage of liquid contained in such a state that the granular material has no surface area. This percentage of liquid is regarded as a true percentage of water absorption of the granular material in question. Data properly coincident with the properties can be obtained by determining the amount of the liquid on the above-described mixture based on the above-described percentage of water absorption.

Regarding the fluidity of the above-described mixture, the development diameter (flow value employed in the art) may be determined as a test value. Further, the determination of the development area enables data conforming to the flow and development state in an actual casting and impregnation condition, so that proper mixing and preparation conditions can be provided.

The development area in the above-described flow test is determined on a plurality of mortars with varied liquid to powder ratios. A straight line on a diagram according to a coordinate showing the relationship between the development area and the liquid to powder mixing ratio follows a law, and the whole phase of the above-described mixture is properly grasped based on the straight line, which enables the change in the fluidity accompanying the variation in the above-described mixing ratio to be understood without conducting specific tests.

Similarly, the whole phase on the relationship between the granular material and the powder as well can be determined under a given mixing condition by determining the above-described development area on a plurality of samples wherein not only the liquid to powder mixing ratio but also the granular material to powder mixing ratio is varied, thereby estimating the property of the mixture.

In the above-described mixture comprising a granular material, a powder and a liquid, each percentage of residual liquid after allowing a drainage energy to act on a plurality of mixtures comprising a powder, such as cement, and a granular material having varied specific surface area, i.e., varied particle size distribution, followed by draining treatment until there occurs substantially no lowering in the liquid content even in the case of an increase in the drainage energy is obtained as a percentage of relative critical adsorbed water which varies proportionally with a change in the specific surface area of the granular material, and the intersection of a straight line formed by the percentage relative critical adsorbed water in a diagram of coordinates expressed in terms of the relationship with the above-described specific surface area and the percentage of residual liquid, and the zero axis of the specific surface area is regarded as a true percentage of water absorption because it is a percentage of liquid absorbed in such a state that the specific surface area is zero. A proper relationship which has not been elucidated in the art on the above-described mixture can be elucidated based on the percentage of water absorption.

The fluidity etc. of the resultant mixture can properly be determined by determining the amount of flowable water, $W_w$, in such a manner that the amount of the above-described flowable fine particle is considered as a function of the percentage of underwater loosening, and predicting and determining the mixing proportion of the mixture based on the amount of the fundamental flowable water.

In general, a mixture can be prepared with a high precision by predicting and determining the fluidity and mixing proportion of the mixture through the use of the above-described percentage of water absorption when kneading is conducted.

In a method which comprises adding part of mixing water, subjecting the mixture to primary kneading, adding the remaining mixing water thereto and kneading the mixture, thereby forming a stable shell coating on the surface of the granular material, the determination of the amount of water in the primary kneading based on the percentage of relative retaining water of the granular material stabilizes the above-described shell coating and enables a mixture having a high quality to be prepared with the highest precision.

When a concrete comprising a coarse aggregate is prepared, a concrete can be efficiently prepared with a high precision by determining the flow value of a mortar based on the slump value necessary for the concrete and the void ratio of the coarse aggregate assembly and determining the mixing proportion based on W/C derived from the flow value and the intended concrete strength.

A proper S/C relationship can be rapidly and properly determined by providing a computing mechanism of a function of S/C on a control panel from the relationship between the flow value or the development area on the flow table and the W/C value.

The incorporation in a control panel of a computing mechanism of a function of the weight or volume of a flowable fine particle and the specific surface area of the granular material and a function deciding section connected thereto enables the relationship therebetween as well to be always rapidly determined.

The mixing proportion of a concrete can be rapidly and accurately obtained by providing on a control panel input means for the W/C determined from the slump value and strength as the mixing condition in an intended mixture, and the void ratio $\psi_G$ of the coarse aggregate assembly, and at the same time providing a computing mechanism of a function of the above-described slump value and the $\psi_G$ value and connected thereto a flow value deciding section for mortar and a judgement computing section and a mixing proportion deciding section for concrete.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
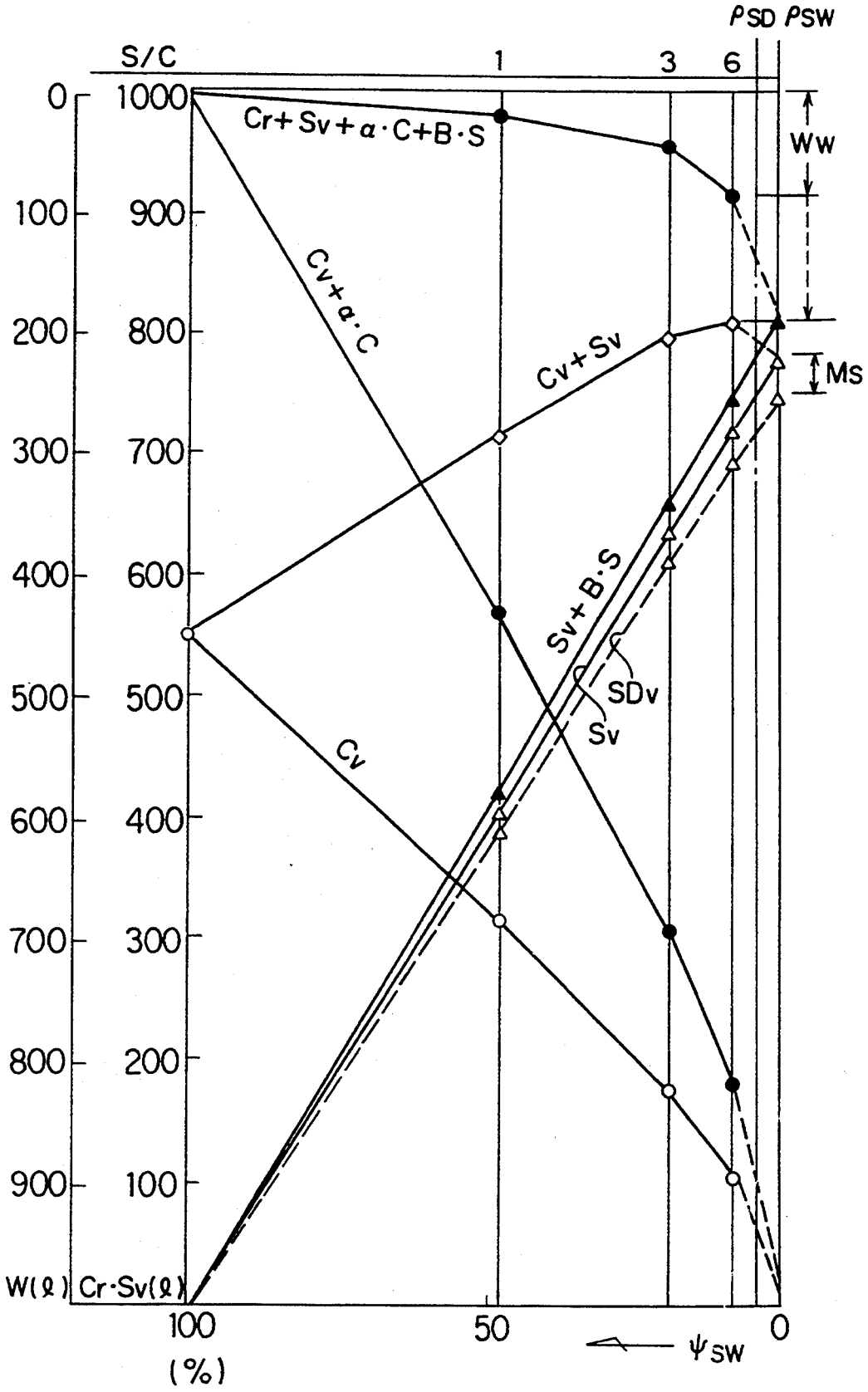
FIG. 1 is a mixing phase diagram in the closest packing wherein a glass beads having a standard particle size and an ordinary Portland cement are used.

In the drawings, numeral 1 designates a cement measuring hopper, numeral 2 a fine aggregate measuring hopper, numeral 3 a coarse aggregate measuring hopper, numeral 4 a first water measuring tank, numeral 5 a second water measuring tank, numeral 6 a water reducing admixture measuring tank, numeral 7 a control panel, numeral 8 a setting section, numeral 9 a mixture, numeral 10 a motor, numerals 11 to 13 storage tanks, numerals 14 and 15 supply sources, numeral 31 a computing mechanism of a function of S/C, numeral 31*a* a setting section for a coefficient thereof, numeral 32 a computing mechanism of a function of $M_{SV}$ and $S_m$, numeral 32*a* a setting section for coefficient thereof, numeral 33 a composite kneading flow value deciding section, numeral 34 a normal kneading flow value deciding section, numeral 35 a judgement computing section, numeral 36 a computing section of a function of $SL-\psi G$, numeral 37 a flow deciding section for mortar, numeral 38 a $\psi G$, setting section, numeral 39 a unit coarse aggregate quantity deciding section, numeral 40 a mixing deciding section as a measuring and setting section for quantity per unit volume of concrete, and numeral 41 a $W_1/C$ deciding section.

DETAILED DESCRIPTION OF THE PREFERRED EMBODIMENT

The present invention will now be described in more detail. The present inventors have made many practical studies and estimation on a kneaded product comprising the above-described grain such as sand, powder such as cement and liquid such as water with a view of properly predicting properties of mixture prepared by mixing or kneading the ingredients, or product molded from the mixture, and planning or preparing a rational mixture and preparing a practical product through determination of a proper design of mixing proportion or analysis of designed mixing proportion (in the present invention these are collectively referred to as "preparation method"). Specifically, many analyses and studies have hitherto been made on the above-described mixture in each field, and various prescriptions or standard specifications are given on the specified mix and field mix in Japan Society of Civil Engineering and JIS. However, in these standards, as described above, the upper limit or lower limit or a wide range is prescribed, and eventually determination is made through trial mixing. This is described also in various literature [for example, "Atarashii Konkurito Kogaku (New Concrete Engineering)" published on May 20, 1987 by Asakura Shoten]. As described above, the trial mixing is apparently accompanied with difficulties and contradictory.

The present inventors have made studies with a view to solving the above-described problems and, as a result, have confirmed that in a mixture wherein the above-described various natural or artificial sands and granular slag, glass beads adjusted so as to have a standard grain size composition and other grains, powders such as cement and water and other liquids (hereinafter representatively referred to simply as "water") are used, in order to elucidate the actual condition of a fine aggregate serving as a skeletal structure or having a skeletal function, i.e., the above-described grain, the weight per unit volume of a packed material (hereinafter referred to as "underwater closest packed material") compacted so as for the gap between grains to become minimum under such a condition that the upper surface of the grain is always substantially level with the water surface in a container having a storage section of a predetermined capacity or others (hereinafter referred to simply as "container") can become an index for properly elucidating properties or characteristics of the above-described mixture and rationally and properly conducting the design of mix proportion, or adjustment, execution or preparation of a specific mixture. The use of such an index enables the determination of the mix proportion of the above-described mixture, prediction of the properties thereof and specific kneading-preparation operation to be smoothly and properly conducted.

At the outset, particulars of the present invention will now be described. Regarding the above-described grain such as fine aggregate, the action of a dehydrating force, such as centrifugal force, on the above-described grain containing a sufficient and large amount of water attached thereon causes the attached water to be removed. The degree of the removal of the attached water varies depending upon the dehydrating force, and the attached water content gradually lowers with an increase in the dehydrating force. However, it has been confirmed that when the degree of lowering reaches a certain limit, there exists a percentage of critical relative adsorbed water, $\beta$, wherein substantially no lowering in the water content is observed even if the dehydrating force is further increased. The $\beta$ value can be apparently determined through the use of a mixture of the grain with a powder such as cement. Alternatively, it can be determined by making use of only a fine aggregate according to a technique described in, for example, JP, A No. 60-139407. Either of the above-described methods may be used. In a powder as well, it has been confirmed that there exists a percentage of critical adsorbed water, $\alpha$, in such a capillary state that powder particles come into contact with each other and the space between powder particles is substantially filled with water and free of continuous air. Further, the present inventors have established techniques including one which can avoid an influence of a contact liquid between the grains and provide proper results of measurement of the percentage relative adsorbed water through the use of a combination with a powder when the percentage critical relative adsorbed water, $\beta$, is measured on the above-described grain. In the present invention, in addition to a novel technique which the present inventors have developed, the elucidation on the underwater closest packed material of a grain such as a fine aggregate is repeated, the underwater weight per unit volume, $\rho_{SW}$, the void ratio of grain, $\psi_{SW}$ (it is a matter of course that the reciprocal thereof is the percentage underwater packing) or the percentage of fine particle, $M_S$, amount of the fundamental flowable water, $W_W$, amount of water necessary for imparting fluidity, $W_B$, etc. are quantitatively determined, and the design of mix proportion, planning and kneading adjustment are properly made based on the obtained numerical values.

The above-described percentage critical adsorbed water varies with a variation in one or two or more of the aggregate, powder and water. Therefore, the specifically obtained percentage adsorbed water is the percentage relative critical adsorbed water. Many experimental results have revealed that the percentage relative critical adsorbed water, $\alpha$ and $\beta$, exists in any of the mixing systems and is always constant in the same mixing composition. For example, when various dehydration treatments are conducted on samples wherein river sand obtained from the Fuji river (Q:2.49, F.M.:2.65, specific gravity in saturated surface-dry condition $\rho H$:2.58, $\rho D$:2.52, $\rho V$:1.739, $\epsilon$:31%, Sm:65.3 $cm^2/g$), ordinary Portland cement and water as a representative liquid are used with the sand to cement ratio (S/C) by weight varied to 0, 1, 2 and 3, at a centrifugal force ranging from 30 G to 1000 G according to the method previously proposed by the present inventors in Japanese Patent Application No. 58-245233 (corresponding to JP, A No. 60-139407), the water content, $W_p/C$ by weight, of a cement paste having a S/C ratio of zero varies depending upon the acted centrifugal force as described. When the sand is mixed therewith, the water content increases with an increase in the S/C value. Substantially no change in the degree of an increase in the water content with an increase in the S/C value is observed based on the case of the above-described cement paste even when the centrifugal force becomes a certain value (e.g., 150 G to 200 G) or more. Specifically, in a region where the gravity is relatively low, such as 100 G or less, the treatment and measurement are conducted under conditions of considerably low centrifugal force difference, such as 30 G, 60 G, 80 G and 100 G. On the other hand, in 200 G or more, even when the treatment and measurement are conducted under conditions of large centrifugal force difference, such as 100 G or more, a relatively large lowering in the water content occurs in any S/C value until the centrifugal force becomes 150 G to 200 G. When the centrifugal force becomes larger than these values, the degree of a lowering in the water content remarkably lowers. Further, the upward gradient angle, $\theta_1$, in a diagram of cartesian coordinates with an increase in the S/C value are substantially constant, so that a straight line having no change in the gradient angle can be obtained. For example, in the case of 438 G and 1000 G, the upward gradient angle, $\theta_1$, is constant despite a centrifugal force increase of 500 G or more. In the case of 200 G as well, it becomes substantially parallel to the case of 1000 G. Specifically, it is confirmed that there exists a percentage relative retaining water of a fine aggregate even when the centrifugal force (dehydrating force) is increased.

When the total amount of water after action of the centrifugal force is $W_z$, the amount of the cement is C, the amount of sand is S, the amount of water in powder after action of the centrifugal force is $W_p$, the amount of water in sand after action of the centrifugal force is W s and the tangent (tan $\theta_1$) of the substantially fixed gradient angle, $\theta_1$, after the centrifugal treatment is taken as the percentage relative retaining water, $\beta$, of the fine aggregate (granular material), the above-described $W_z/C$ can be expressed by the following equation [I]:

$$W_z/C = W_p/C + \beta \cdot S/C \quad \text{[I]}$$

Further, $\beta$ can be expressed by the following equation [II]:

$$\beta = \tan\theta_1 = \frac{W_s/C}{S/C} = \frac{W_s}{S} \quad \text{[II]}$$

Therefore, the above-described amount of water, $W_s$, in the sand can be expressed by the following equation [III]:

$$W_s = W_z - W_p \quad \text{[III]}$$

Specifically, $\beta$ is a water content obtained by dividing the amount of water content in the sand by the amount of the sand and regarded as the critical relative adsorbed water of the granular material. The results of the determination of the $W_z/C$ value by the equation [I] and the precision ($\gamma^2$) based on the actually measured value are shown in Table 1. From Table 1, it is confirmed that the precision is at least 0.98. Therefore, the precision is very high.

TABLE 1

| Centrifugal force | $W_Z/C = W_p/C + \beta\ S/C$ | $\gamma^2$ |
|---|---|---|
| 1000 G | $W_Z/C = 14.86 + 3.70\ S/C$ | 0.998 |
| 438 G | $W_Z/C = 18.68 + 3.98\ S/C$ | 0.996 |
| 300 G | $W_Z/C = 20.19 + 4.21\ S/C$ | 0.996 |
| 200 G | $W_Z/C = 22.57 + 4.16\ S/C$ | 0.9998 |
| 150 G | $W_Z/C = 25.46 + 4.83\ S/C$ | 0.988 |
| 120 G | $W_Z/C = 26.70 + 5.00\ S/C$ | 0.998 |
| 100 G | $W_Z/C = 27.50 + 5.10\ S/C$ | 0.9995 |
| 80 G | $W_Z/C = 28.55 + 5.53\ S/C$ | 0.9998 |
| 60 G | $W_Z/C = 28.68 + 6.62\ S/C$ | 0.9998 |
| 30 G | $W_Z/C = 31.40 + 6.48\ S/C$ | 0.998 |

From these results, regarding the relationship between the centrifugal force, G, and the above-described $\beta$, i.e., $W_s/S$, it is apparent that the percentage of relative adsorbed water, $\beta$, gradually lowers until the centrifugal force reaches 200 G and, when the centrifugal force exceeds 200 G, substantially dehydration are obtained without the constant lowering in the percentage of relative adsorbed water, $\beta$. Specifically, there is obtained an angle, $\theta_2$, at which the above-described lowering in the percentage relative adsorbed water, $\beta$, caused until the centrifugal force reaches to 150 to 200 G intersects the substantially horizontal straight line obtained on the action of a centrifugal force of 150 to 200 G or more. The $\theta_2$ value varies depending upon the properties of fine aggregates. The angle $\theta_2$ can be regarded as a percentage of interfacial dehydration per G representing the dehydrating characteristics which is depending upon the magnitude of the dehydration energy in each aggregate.

The above-described value of the percentage of relative adsorbed water which does not substantially change even when the centrifugal force increases can be regarded as the percentage critical adsorbed water ($\beta_0$) on the aggregate. The percentage of maximum relative adsorbed water, $B_{0max}$, is the intersection of the slant straight line of $\theta_2$ and a centrifugal force of zero, and the percentage of total relative adsorbed water $\beta_{GO}$, is one obtained by adding $\beta_{0max}$ to the percentage critical adsorbed water, $B_0$. The centrifugal treatment causes the aggregate to be dehydrated in the percentage of adsorbed water, $\beta_{0max}$. Further, as described above, the centrifugal force value at which the percentage of adsorbed water does not substantially change with an increase in the centrifugal force can be determined as $G_{max}$.

Figure 4:
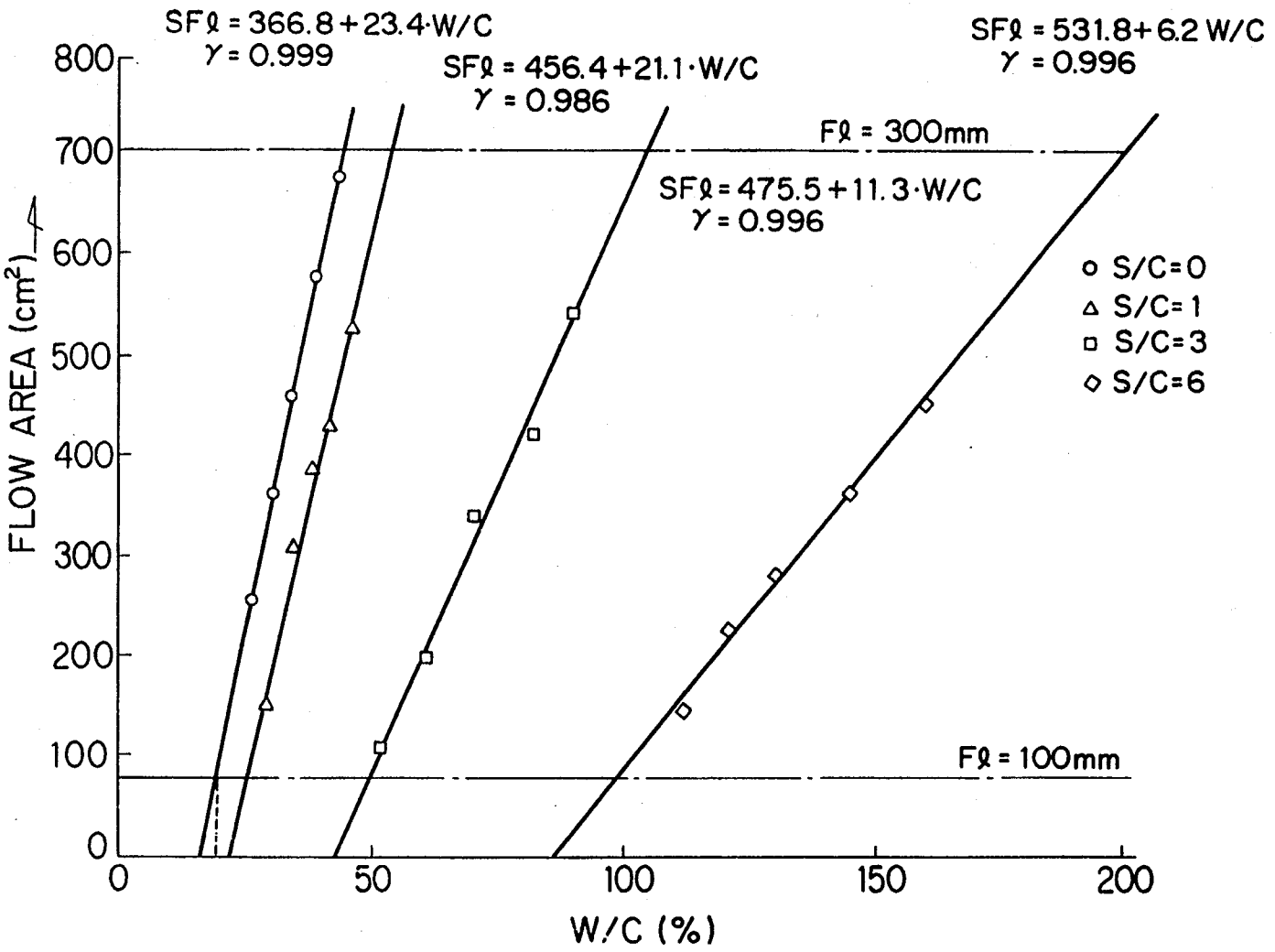
FIG. 4 is a diagram for the same Atsugi crushed mortar as that in FIG. 3 showing the relationship between the flow area (SFl) instead of the flow value and the W/C value.

That the water content in a capillary region regarding the paste of the powder corresponds to that around the maximum value of the torque during kneading and operation is reported by the present inventors in FIG. 4 of JP, A No. 58-56815 (the fanicular or capillary referred to in said publication has been confirmed to be a capillary region by the subsequent studies). Specifically, when a powder in absolute dry condition is kneaded while gradually adding water, the kneading torque increases with a gradual increase in the amount of addition of water. After the torque increased with an increase in the amount of water reaches the maximum value, a further increase in the amount of water causes the torque to be gradually decreased. This is because water in the paste completely fills the gap between powder particles to prepare a slurry and the gradual increase in the amount of water present between the powder particles increases the fluidity. That is, the kneading torque becomes maximum in a capillary region immediately before the gap between the powder particles is completely filled with water (i.e., a slurry is formed). The above-described laid-open specification discloses that, when the kneading product is prepared under the maximum kneading torque condition, the occurrence of bleeding water is effectively reduced and the resultant kneaded product is excellent in the strength and other characteristics. In the present invention, the water content in such a capillary region ($W_P/C$) is taken as a and adopted as an important factor together with the above-described percentage of critical adsorbed water, $\beta_0$.

Regarding the above-described kneaded product comprising a powder, a grain and a liquid, the present inventors have studied by making use of a centrifugal force such a state that, as described above, the percentage of adsorbed water, $\beta$, does not substantially lower even when a centrifugal force is increased to a certain value or more. As a result, it has been found that voids exist within the packed structure due to high centrifugal force, e.g., 150 to 200 G (which slightly varies depending upon the property of the grain) and therefore the structure is different from the actual packed and deposited structure except for the case of mere dehydration. In view of this, studies have been made on the formation of the same state as that formed by the application of the above-described centrifugal force, i.e., 150 to 200 G, through the use of a method which is one other than the centrifugal method and does not produce voids. As a result, it has been confirmed that an equal state can be formed also by the compacting and vibration or impaction. Regarding this method, the present inventors have made detailed studies on a number of combinations of fine aggregates with cement powders. As a result, they have found that a preferred method comprises charging a cylindrical container (volume measure) having a diameter of 11.4 cm, a height of 9.8 cm and a capacity of 1000 cc with about 500 cc of a sample, uniformly compacting the sample 25 times or more all over the sample within the container by means of a compacting rod for a table flow having a weight of 500 g, conducting three times or more a stamping procedure of raising the container above 2 to 3 cm from a supporting table and allowing the containing to fall, thereby unifying the packed state, further charging the container with about 500 cc of the sample, and conducting the same compacting and stamping procedures as those described above. The closest packed state can be attained by conducting the compacting about 25 times by means of a compacting rod under such a condition that a container having the above-described diameter is charged with the above-described amount of the sample. Even if a further compacting procedure is conducted, the weight per unit volume does not substantially vary. In the stamping procedure as well, the stamping of about 3 times suffices for this purpose, and if the amount is about 500 cc, substantially no change is observed even when the procedure is repeated 4 times or more. In particular, in the present invention, the above-described compacting or stamping procedure is conducted under such a condition that the water surface is substantially level with the grain surface through addition of water to the sample surface within the container (or removal of excessive water by means of a dropping pipet) if necessary. This demonstrates that there occurs underwater compacting. Further, as opposed to the case where a water layer is formed on the sample surface, in the present invention, it is necessary that the underwater compacting is conducted under such a condition that water is always level with the sample, i.e., the whole quantity of the sample neither separates nor segregates, although they are the same with each other in the underwater compacting.

According to the above-described method, various samples having the same S/C with gradually varied W/C values have been studied. As a result, the maximum volume (weight per unit volume) is obtained when the W/C value is a certain value. For example, glass beads having a diameter of 0.075 to 5 mm, i.e., glass beads provided so as to have a representative or standard grain size distribution as a fine aggregate and having a F M value of 2.71, a grain size distribution shown in Table 2 and a true specific gravity, $\rho_s$, of 2.45, were provided as a reference material having the same particle size distribution as that of sand as a fine aggregate and regular shape.

TABLE 2

| Sieve opening (mm) | 5 | (5~) 2.5 | (2.5~) 1.2 | (1.2~) 0.6 | (0.6~) 0.3 | (0.3~) 0.15 | 0.15 or less |
|---|---|---|---|---|---|---|---|
| oversize (%) | 5 | 5 | 20 | 25 | 22 | 17 | 6 |

The results shown in Table 3 were obtained when the above-described under-water compacting procedure was conducted on each sample wherein the water to cement ratio (W/C) was successively varied with a sand to cement ratio (S/C) of 1. Specifically, when W/C was 28%, the weight per unit volume (hereinafter often referred to as "volumetric weight"), $\rho$, was 2,235 g, i.e., the closest packed state was obtained. The volumetric weight, $\rho$, becomes smaller in both cases where the W/C is lower and higher than that value.

TABLE 3

| | Properties | | Weight per unit volume | | | | |
|---|---|---|---|---|---|---|---|
| W/C | volumetric weight $\rho$ | air | C | W | S | $\Psi_S$ | $\epsilon$ |
| 20 | 1.641 | 31.1 | 746 | 149.2 | 746 | 58.9 | 18.0 |
| 22 | 1.849 | 21.4 | 833 | 183.3 | 833 | 54.1 | 20.5 |
| 24 | 2.175 | 6.4 | 971 | 233.3 | 971 | 46.5 | 23.9 |
| 26 | 2.211 | 3.7 | 978 | 254.3 | 978 | 46.1 | 25.8 |
| 28 | 2.235 | 1.5 | 980 | 274.4 | 980 | 46.0 | 27.6 |
| 30 | 2.212 | 1.5 | 962 | 288.6 | 962 | 47.0 | 29.0 |
| 32 | 2.197 | 1.0 | 947 | 303.0 | 947 | 47.8 | 30.4 |
| 34 | 2.177 | 0.9 | 930 | 316.2 | 930 | 48.7 | 31.7 |

Similarly, when the same glass bead and portland cement as those used above were used with a S/C value of 3, a volumetric weight, $\rho$, of 2,277 g was obtained when the W/C was about 33%. As with the results shown in Table 3, the volumetric weight, $\rho$, becomes lower when the W/C was increased or decreased by 1% from the above value. Further, when the S/C was 6, the maximum volumetric weight, $\rho$, was obtained at the W/C, about 48%. The volumetric weight, $\rho$, lowers in both cases where the W/C becomes higher and lower than the above value.

It is true of the case where the glass bead used as the above reference material is natural sand (river sand, beach sand and pit sand) artificial sand (crushed sand and slag particle) commonly used as a fine aggregate. The presence of the peak point in connection with the W/C value is the same as the case where the peak point of the kneading torque is present on the powder (cement). Further, as described above, the W/C at which the volumetric weight, $\rho$, exhibits a peak point is the same as that obtained in the case where centrifugal treatment conducted at a centrifugal force of 150 G to 200 G, and the difference is substantially within a measurement error.

The underwater closest packing according to the present invention wherein the sample is made level with water may be conducted by a method wherein use is made of a graduated cylinder. For example, a sample sand and water are placed in a graduated cylinder having a capacity of 1000 cc, the graduated cylinder is allowed to fall on a table from a position 5 cm above the table, and the impaction packing is repeated 150 times. Even if the same packing procedure is conducted, the closest packing conducted according to the present invention wherein the water surface is level with the grain surface exhibits a higher weight per unit volume than that in other packing methods wherein use is made of an oven-dried sand without water, or a sample is placed in excess water for packing procedure even if water is used. For example, the closest packing of Atsugi crushed sand having a FM value of 3.12, a percentage of water absorption of 1.33 according to JIS and a specific gravity of 2.58 was conducted according to the above-described method, and the results thereof are shown in Table 4.

TABLE 4

| | |
|---|---|
| (1) Closest packing of compacting in absolute dry condition | 1.729 kg/l |
| (2) Closest packing of same level underwater compacting | 1.796 kg/l |
| (3) Closest packing in graduated cylinder in absolute dry condition | 1.591 kg/l |
| (4) Closest packing in compacting graduated cylinder in same level underwater | 1.710 kg/l |

In the case of the compacted packing or graduated cylinder packing, the measured weight per unit volume varies depending upon the method used. By contrast, the same level underwater closest packing method according to the present invention exhibits a high weight per unit volume in any cases. The closest packing was conducted on a plurality number of samples of the same kind under the same condition to determine the variation in the weight per unit volume. As a result, it has been confirmed that the variation on the absolute dry samples was about ±0.018 to 0.020 kg/l while the underwater closest packing exhibited a variation of about 0.003 to 0.006 kg/l, i.e., provided stable and proper results of measurement of the weight per unit volume in the closest packing.

In the present invention, the above-described method is utilized as a preferred representative testing method since the packing is made closest and this state is well in agreement with that in the case of the actually packed and placed state of this kind of kneaded product. As described above, the compacting by means of a compacting rod is conducted 25 times for each of the upper and lower layers, and the stamping is conducted 3 times for each layer. They should be uniformly conducted.

The test and measurement in the closest packed state were conducted on many samples. As a result, it has been found that there is a factor on the amount of water based on the amount of cement and sand in this kind of kneaded product which cannot be elucidated even when the $\alpha$ and $\beta$ values are used. The above-described factor is involved also in any sample wherein the amount of the cement and sand varied to various values. The above-described glass bead shown in Table 2, Sagami river sand and Fuji river sand were used as a granular material, and a normal portland cement was used as a powder to prepare various kneaded products having various S/C values, followed by formation of the above-described closest packed state. Regarding the amount of water based on the amount of cement, W/C, in the thus formed closest packed state, the values determined by calculation through the use of $\alpha$ and $\beta$ were compared with the measured values on actual kneaded products. As a result, the measured values deviated by 4 to 5% in the case of S/C=2 from the calculated values. When the S/C value becomes higher than this value, the deviation of the measured value from the calculated value acceleratingly increases. This suggests that there exists a third factor other than $\alpha$ and $\beta$ in the closest packed state wherein substantially no change in the water content occurs even when a force is further applied. More particularly, when the S/C is about 1, i.e., when the amount of sand is relatively small, since a large amount of powder (cement) is present between sand particles, the presence of the cement in a large amount may deem to be the third factor. However, even when the S/C is 2 or 3 or more, i.e., the amount of the powder (cement) relatively becomes small, the deviation of the calculated value from the measured value is not reduced at all and tends to regularly and remarkably increase. That is, it is apparent that not only the above-described $\alpha$ and $\beta$ but also a third factor acts.

Accordingly, the present inventors have made extensive and intensive studies with a view to elucidating the third factor and, as a result, have found that the third factor is eventually water held within the kneaded product due to the structure or texture. However, when the above-described structure or texture is observed on the packed texture of the kneaded product, it is apparent that the sand constitutes the skeletal function or structure, and the degree of the gap between grains such as sand (percentage looseness or packed state) deems to play a dominant role. In a grain available as a raw material for kneading, such as sand, it is unavoidable for a particulate component (fine sand) to be deposited and included to such an extent that it neither performs the above-described skeletal function nor constitutes the above-described skeletal structure. Therefore, a proper elucidation cannot be conducted without subtraction of the above-described particulate content (fine sand content). However, it is a matter of course that how to determine the particulate content (fine sand content) has never been considered in the art. Even if this is taken into consideration through classification by means of a fine sieve mesh, it is unclear that which size of the particulate component gives an effect as the above-described third factor, and further there is a great tendency that the particulate component is classified in such a state that it is deposited on the granular material, which renders this method improper.

It is a matter of course that the grain size, grain diameter, etc. as well have an effect on the measurement of the solid volume percentage of sand. It is known that even when they are the same, the degree of influence varies depending upon wether or not the water content is present. Specifically, when the surface moisture exists in the fine aggregate, the aggregate grain is disturbed by the adhesion of the surface moisture, so that when the water content is generally between about 6% and about 12%, the weight per unit volume becomes minimum and decrease by 20 to 30% from that in the case of absolute dry condition. Since this is apparently understood as a bulking of volume, it is common knowledge that the weight per unit volume should be measured in absolute dry condition. However, as shown in the above Table 4, the present inventors have found that when the weight per unit volume measured on the sand in absolute dry condition after forming a compacted state wherein the gap between grains of the sand becomes minimum is compared with that measured on the case where the compacting is conducted under such a underwater condition that the gap between grains is filled with water, the solid volume percentage (weight per unit volume) in the case of underwater packing is larger than that in the case of the absolute dry condition despite the fact that the compacting conditions used are quite the same. Specifically, the results of measurement in the same level underwater closest packed state on various mortars and pastes through the use of the above-described glass bead having a standard grain size and an ordinary portland cement with S/C value of 6 or less were summarized, and the percentage of underwater looseness ($\psi_{SW}$) were plotted as abscissa and the amount of water (W), unit volume of cement ($C_V$) and unit volume of sand ($S_V$) as ordinate. The relationship thereof, the state of change of $C_V+S_V+\alpha\cdot C+\beta\cdot S$, $C_V+\alpha\cdot C$, $C_V+S_V$, $C_V$, $S_V+\beta\cdot S$ and $S_V$ and $S_{DV}$, and the relationship of the fundamental unit amount of water, $W_W$, and the amount of fluid particulate component per unit volume, $M_s$, are shown in FIG. 1. Thus, it is possible to properly analyze the specific relationship on the above-described mortars.

Figure 2:
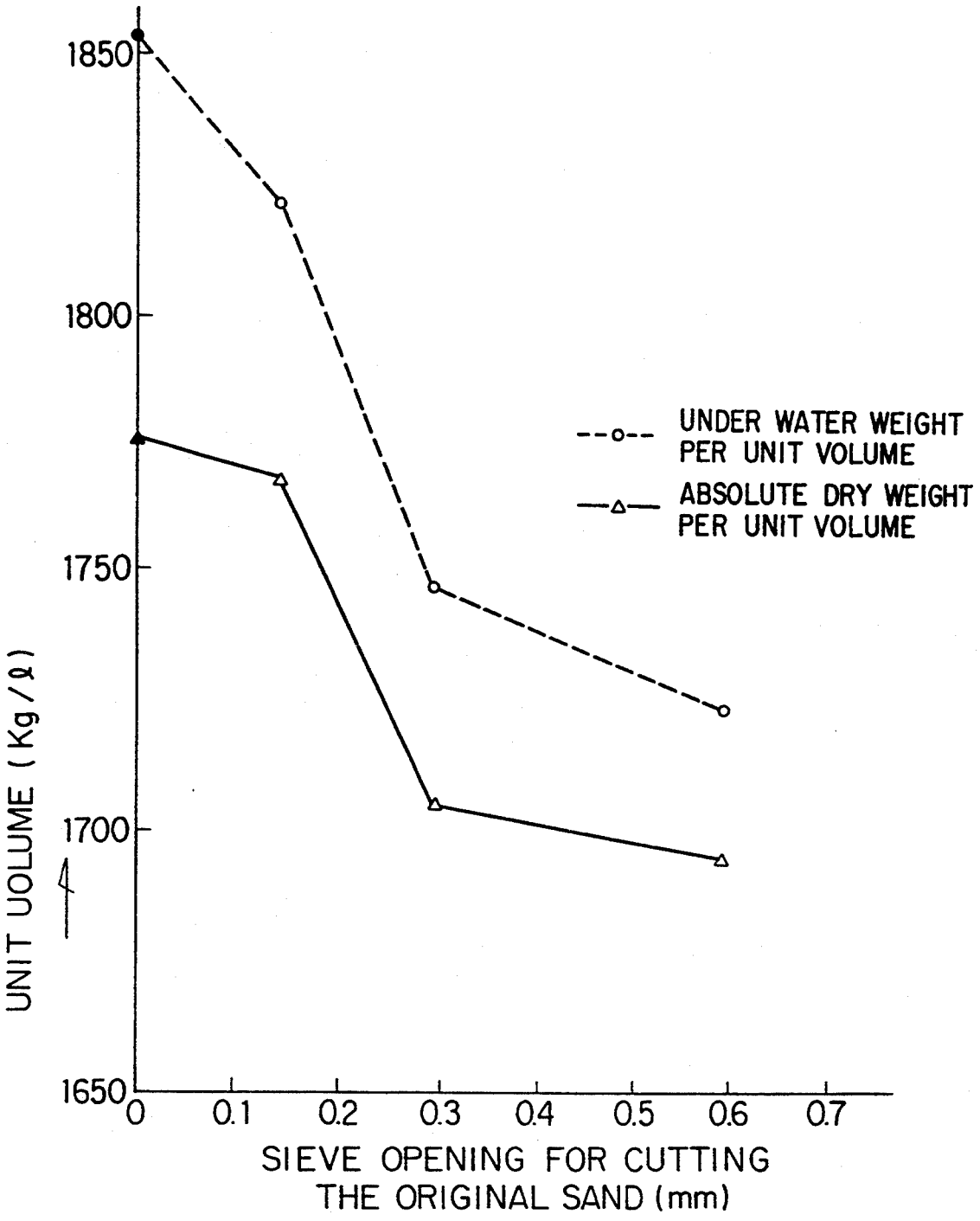
FIG. 2 is a diagram showing the results of measurements of the underwater weight per unit volume and the absolute dry standard on a glass bead having a standard particle size wherein the measurements are conducted on an original sand and after cutting off particles having a size of 0.15 mm or less, 0.3 mm or less and 0.6 mm or less.

On the other hand, FIG. 2 shows the underwater weight per unit volume, $\rho_{SW}$, and the weight per unit volume in absolute dry condition, $\rho_{Sd}$, for the above-described closest packed state on standard grain size glass bead wherein grains having a size of 0.15 mm or less, 0.3 mm or less and 0.6 mm or less are cut off as well as on an original sand. In any case, a considerable difference is observed therebetween.

Specifically, even in the case of the above-described sample of an artificially prepared glass bead which is relatively small in the unevenness around the peripheral surface and the pore, there is a difference of 30 to 80 g/l between the weight per unit volume, $\rho_{SD}$, in the closest packed state in absolute dry condition and the weight per unit volume, $\rho_{SW}$, in the closest packed state under the underwater same level condition. Regarding the above-described glass bead, the difference between $\rho_{SD}$ and $\rho_{SW}$ in each closest packed state of the above-described glass beads wherein grains having a size of 0.15 mm or less, 0.3 mm or less and 0.6 mm or less are cut off is gradually reduced. However, it is a noticeable phenomenon that in an artificial glass bead having substantially no water absorbing pore, there is a difference shown in FIG. 2 depending upon whether the closest packed state is formed under water or in absolute dry condition.

The relationships as shown in FIGS. 1 and 2 have been determined also on other natural or artificial fine aggregate (such as crushed stone). As a result, in general, regarding the above-described fine aggregate, the relationship on variation similar to the above-described one exists between the absolute dry weight per unit volume ($\rho_{SD}$) and the underwater weight per unit volume ($\rho_{SW}$) depending upon the percentage coarse grain (FM). In particular, in the relationship shown in FIG. 2, the difference becomes large in the case of a general fine aggregate.

The above-described difference between the weight per unit volume $\rho_{SD}$ and $\rho_{SW}$ in the closest packed state, particularly the relationship $\rho_{SW}>\rho_{SD}$ is difficult to understand through the conventional technical idea of bulking. Detailed studies conducted by the present inventors have revealed that this is attributable to the particulate component (fine sand component). Specifically, also in the above-described FIG. 2, it can be said that the value of ($\rho_{SW}-\rho_{SD}$) decreases with an increase in the sieve mesh for cutting-off. In FIG. 1, this is shown all over the region. The percentage of particulate per unit volume (percentage particulate), Ms, can be specifically determined by the following equation I:

$$M_s = \frac{\rho_{SW} - \rho_{SD}}{\rho_S} \times 100 \qquad \text{I}$$

wherein $\rho_s$ is the true specific gravity.

When the percentage particulate (percentage impalpable powder), Ms, is determined as described above, in the present invention, the void ratio, $\psi_s$, of grain such as sand which performs an important skeletal function as the above-described third factor is determined by the following equation II in terms of the $\psi_{SW}$ in an underwater state since grains are underwater when the $\rho_{SW}$ is determined under underwater condition:

$$\psi_{SW} = \left(1 - \frac{S}{\rho_{SW}}\right) \times 100 \qquad \text{II}$$

Further, if necessary, the $\psi_{SW}$ in an underwater state can be replaced with one based on the absolute dry condition. The porosity of grain in absolute dry condition, $\psi_{SD}$ can be expressed by the following equation III:

$$\psi_{SD} = \left(1 - \frac{S}{\rho_{SD}}\right) \times 100 \qquad \text{III}$$

The $\psi_{SW}$ in an underwater state expressed by the above-described equation II may be specifically measured by the following method besides the above-described measurement after compaction by means of a volumetric weight measure. A volumetric weight measure, 500 ml-graduated cylinder and water are provided. The above-described volumetric weight measure (1000 cc) is charged with 100 ml of water and then a sand in absolute dry condition in an amount corresponding to one-third of the depth of the container. The mixture is well stirred by means of a rod, and the left and right sides of the volumetric weight mass are each lightly beaten 10 times (20 times in total) by a wooden hammer. Further, the sand is added in an amount corresponding to two-third of the depth of the volumetric weight measure, the mixture is stirred in the same manner as that described above, and the volumetric weight measure is lightly beaten 20 times in total by a wooden hammer. At that time, if necessary, water is poured so that water is in a position several mm above the surface of the sand. Similarly, the sand and water are alternatively poured so that the level is 2 to 3 mm below the top surface of the container, the container is beaten 20 times, and only sand is added so that the sand surface is level with the water surface on the upper surface of the container. If necessary, water is poured or pipetted, and the pipetted water is returned to the graduated cylinder. The sand is leveled by means of a metal spatula etc. so that the sand surface is level with the water surface on the upper surface of the container. The total weight (W) is measured, and the underwater weight per unit volume, $\rho_{SW}$, can be determined by following equation IV:

$$\rho_{SW} = \frac{W - \left[a + \frac{(500 - b)}{\rho_W}\right]}{1000} \times \frac{1}{V} \qquad \text{IV}$$

wherein a: tare of container, b: amount of water remaining in the graduated cylinder, and V: the volume of container (1000 cc in this case).

It is apparent that the weight per unit volume in absolute dry condition, $\rho_{SD}$, can be determined by making use of sand in absolute dry condition through the same procedure or calculation as that in the case where use is made of $\rho_{SW}$. The above-described $\psi_{SW}$ and the void ratio in absolute dry condition, $\psi_{SD}$, are expressed by the following equation V through the use of $\rho_{SD}$, obtained in absolute dry condition.

$$\psi_{SD} = \left(1 - \frac{S}{\rho_{SD}}\right) \times 100\ (\%) \qquad \text{V}$$

Alternatively, the absolute dry weight per unit volume, may be determined as follows. A sand in absolute dry condition is placed in three divided layers in the above-described container (measure). In this case, in each layer, the left and right sides of the container are each lightly beaten 10 times (20 times in total) by a wooden hammer. After packing, the upper surface is leveled by means of a ruler having a triangular corner, and the weight is measured.

The above-described $\rho_{SW}$, $\rho_{SD}$, the void ratio (or percentage of packing), $\psi_{SW}$, $\psi_{SD}$, and the percentage particulate or percentage impalpable powder, etc. were determined on samples comprising glass bead (1), Fuji river sand (2) and Sagami river crushed sand (3) provided so as to have a standard grain size distribution of the above-described fine aggregate having a diameter of 0.075 to 5 mm with the sand (glass bead)/cement weight ratio (S/C) being 0 to 6. The results are shown in Tables 5 to 7.

In Table 5 to 7, $W_P$ is the water content of capillary region of cement, $S_W$ is the critical relative adsorbed water content, $W_P/C \times 100$ is the above-described $\alpha$, and $S_W/C \times 100$ is the above-described $\beta$. Further, $W_W$ is the amount of water within the structure other than the above-described cement (C), sand (S) and their $\alpha$ and $\beta$ and a fundamentally necessary unit amount of water independent of the occurrence of the fluidization or molding depending upon the water.

TABLE 5

| Kind of granular material | | | | Glass bead 1 | | |
|---|---|---|---|---|---|---|
| $\rho_c$ (true specific gravity of cement) | 3.16 | $\rho_{SD}$ (bulk specific gravity in absolute dry condition) t/m$^3$ | 1.814 | $\alpha = W_p/C$ | | 25.77% |
| $\rho_s$ (true specific gravity of sand) | 2.45 | $\rho_{SW}$ (bulk specific gravity under water) t/m$^3$ | 1.888 | $\beta = S_W/S$ | | 1.74% |
| $\rho_H$ (specific gravity in saturated surface-dry condition) | 2.451 | $\epsilon_V$ (porosity) | 0.26 | percentage particulate (percentage fine sand) $M_S = \frac{\rho_{SW} - \rho_{SD}}{\rho_S} \times 100$ | | 3.02% |
| $S_m$ (specific surface area) cm$^2$/g | 60.0 | | | | | |
| Q (JIS percentage of water absorption | 0.048 | $\epsilon_W$ (porosity in wet state) | 0.229 | amt. of particulate (amt. of fine sand) $\rho_{SW}-\rho_{SD}$ | | 74 kg/m$^3$ |
| | 2.67 | | | | | |

| S/C (sand to cement volume ratio) | 0. | 1. | 2. | 3. | 6. | $S = \rho_W \infty$ |
|---|---|---|---|---|---|---|
| $(S/C)_v$ (sand to cement weight ratio) | | 1.29 | | 3.86 | 7.72 | |
| W (water) kg/m$^3$ | 448.8 | 275.4 | | 169.6 | 139.2 | |
| C (cement) kg/m$^3$ | 1741.1 | 980 | | 514 | 290 | |
| S (sand: glass bead) kg/m$^3$ | | 980 | | 1542 | 1740 | 1888 |
| Air % | | 1.5 | | 3.7 | 5.9 | |
| $C_v$ (unit volume of cement) l/m$^3$ | 551.2 | 310 | | 163 | 92 | |
| $S_v$ (unit volume of sand) l/m$^3$ | | 400 | | 629 | 710 | 771 |
| $\alpha \cdot C$ (amt. of water constrained by cement) l/m$^3$ | 448.8 | 252.5 | | 132.5 | 74.7 | |
| $\beta \cdot S$ (amount of water constrained by sand) l/m$^3$ | | 17.1 | | 26.8 | 30.3 | 31.7 |
| $C_v + S_v$ l/m$^3$ | | 710 | | 792 | 802 | |
| $C_v + \alpha_c$ l/m$^3$ | | 562.5 | | 295.5 | 166.7 | |
| $S_v + \beta \cdot S$ l/m$^3$ | | 417.1 | | 655.8 | 740.3 | 802.7 |
| $\Sigma = C_v + S_v + \alpha \cdot C + \beta \cdot S$ l/m$^3$ | 1000 | 979.6 | | 951.3 | 907 | |
| $W_W = 1000 = \Sigma$ l/m$^3$ | 0 | 20.4 | | 48.7 | 93 | |

TABLE 5-continued

| | | | | | |
|---|---|---|---|---|---|
| $\Psi_{SW} = \left(1 - \frac{S}{\rho_{SD}}\right)100(\%)$ | 100 | 46 | 15 | 4.1 | −4.1 |
| $\Psi_{SW} = \left(1 - \frac{S}{\rho_{SW}}\right)100(\%)$ | 100 | 48.1 | 18.3 | 7.8 | 0 |

NOTE: $W_W$ contains air as well.

TABLE 6

| Kind of granular material | | | Fuji river sand 2 | | |
|---|---|---|---|---|---|
| $\rho_c$ (true specific gravity of cement) | 3.16 | $\rho_{SD}$ (bulk specific gravity in absolute dry condition) t/m$^3$ | 1.680 | $\alpha = W_p/C$ | 25.73 |
| $\rho_s$ (true specific gravity of sand) | 2.45 | $\rho_{SW}$ (bulk specific gravity under water) t/m$^3$ | 1.823 | $\beta = S_W/S$ | 4.2 |
| $\rho_H$ (specific gravity in saturated surface-dry condition) | 2.61 | $\epsilon_V$ (porosity) | 33.9 | percentage particulate (percentage fine sand) $M_S = \frac{\rho_{SW} - \rho_{SD}}{\rho_S} \times 100$ | 5.63% |
| $S_m$ (specific surface area) cm$^2$/g | 67.3 | | | | |
| Q (JIS percentage of water absorption | 2.58 | $\epsilon_W$ (porosity in wet state) | 28.2 | amt. of particulate (amt. of fine sand) $\rho_{SW}$-$\rho_{SD}$ | 143 kg/m$^3$ |
| F · M | 2.55 | Unit absolute dry volume | 661.4 l/m$^3$ | | |

| | | | | | | |
|---|---|---|---|---|---|---|
| S/C (sand to cement volume ratio) | 0. | 1. | 2. | 3. | 6. | $S = \rho_W \infty$ |
| $(S/C)_v$ (sand to cement weight ratio) | 0 | 1.24 | 2.49 | 3.73 | 7.47 | |
| W (water) kg/m$^3$ | 448.8 | 297.1 | 255 | 263 | 257 | |
| C (cement) kg/m$^3$ | 1743 | 974 | 670 | 496.1 | 270.8 | 0 |
| S (sand: glass bead) kg/m$^3$ | 0 | 974 | 1340 | 1488.4 | 1624.9 | 1823 |
| Air % | | 1.1 | 1.3 | −0.6 | 1.7 | |
| $C_v$ (unit volume of cement) l/m$^3$ | 551.6 | 308.2 | 212 | 157 | 85.7 | |
| $S_v$ (unit volume of sand) l/m$^3$ | 0 | 383.5 | 527.6 | 586 | 640 | 771.7 |
| $\alpha \cdot C$ (amt. of water constrained by cement) l/m$^3$ | 448.5 | 250.6 | 172.4 | 127.6 | 69.7 | |
| $\beta \cdot S$ (amount of water constrained by sand) l/m$^3$ | 0 | 40.9 | 56.3 | 62.5 | 68.2 | 76.6 |
| $C_v + S_v$ l/m$^3$ | 551.6 | 671.1 | 739.6 | 74.3 | 725.7 | |
| $C_v + \alpha_c$ l/m$^3$ | 1000 | 558.8 | 384.4 | 284.6 | 155.4 | |
| $S_v + \beta \cdot S$ l/m$^3$ | | 424.4 | 583.9 | 648.5 | 708.2 | 794.3 |
| $\Sigma = C_v + S_v + \alpha \cdot C + \beta \cdot S$ l/m$^3$ | 1000 | 983.6 | 968.3 | 933.1 | 963.6 | |
| $W_W = 1000 - \Sigma$ l/m$^3$ | 0 | 16.8 | 31.7 | 66.9 | 136.4 | |
| $\Psi_{SW} = \left(1 - \frac{S}{\rho_{SD}}\right)100(\%)$ | | 42 | 20.2 | 11.4 | 3.3 | −8.51 |
| $\Psi_{SW} = \left(1 - \frac{S}{\rho_{SW}}\right)100(\%)$ | 100 | 46.6 | 26.5 | 18.4 | 10.9 | 0 |

NOTE: $W_W$ contains air as well.

TABLE 7

| Kind of granular material | | | Sagami river crushed sand 3 | | |
|---|---|---|---|---|---|
| $\rho_c$ (true specific gravity of cement) | 3.16 | $\rho_{SD}$ (bulk specific gravity in absolute dry condition) t/m$^3$ | 1.667 | $\alpha = W_p/C$ | 25.06% |
| $\rho_s$ (true specific gravity of sand) | 2.58 | $\rho_{SW}$ (bulk specific gravity under water) t/m$^3$ | 1.728 | $\beta = S_W/S$ | 3.44% |
| $\rho_H$ (specific gravity in saturated surface-dry condition) | 2.61 | $\epsilon_V$ (porosity) | 35.4% | percentage particulate (percentage fine sand) $M_S = \frac{\rho_{SW} - \rho_{SD}}{\rho_S} \times 100$ | 2.36% |
| $S_m$ (specific surface area) cm$^2$/g | 60.4 | | | | |
| Q (JIS percentage of water | 1.04% | $\epsilon_W$ (porosity in wet state) | 33% | amt. of particulate (amt. of fine sand) | 61 kg/m$^3$ |

TABLE 7-continued

| absorption F · M | 2.70 | Unit absolute dry volume | 646.1 l/m³ | $\rho_{SW}$-$\rho_{SD}$ | | | |
|---|---|---|---|---|---|---|---|
| S/C (sand to cement volume ratio) | | 0. | 1. | 2. | 3. | 6. | $S = \rho_W \infty$ |
| $(S/C)_v$ (sand to cement weight ratio) | | 0 | 1.22 | 2.45 | 3.68 | 7.35 | |
| W (water) kg/m³ | | 441.9 | 278.2 | 244.5 | 257.6 | 250.9 | |
| C (cement) kg/m³ | | 1763.5 | 993.4 | 679.2 | 505.1 | 278.7 | |
| S (sand: glass bead) kg/m³ | | 0 | 973.4 | 1358.3 | 1515.3 | 1672.4 | 1728 |
| Air % | | | 2.2 | 1.4 | −0.5 | 1.3 | |
| $C_v$ (unit volume of cement) l/m³ | | 558.1 | 314.4 | 214.9 | 159.8 | 88.2 | |
| $S_v$ (unit volume of sand) l/m³ | | | 385.6 | 526.5 | 587.3 | 648.2 | 669.8 |
| $\alpha \cdot C$ (amt. of water constrained by cement) l/m³ | | 441.9 | 248.9 | 170.2 | 126.6 | 69.8 | |
| $\beta \cdot S$ (amount of water constrained by sand) l/m³ | | 0 | 34.2 | 46.7 | 52.1 | 75.5 | 59.4 |
| $C_v + S_v$ l/m³ | | 558.1 | 669.4 | 741.4 | 747.1 | 736.4 | |
| $C_v + \alpha_c$ l/m³ | | 1000 | 563.3 | 385.1 | 286.4 | 158 | |
| $S_v + \beta \cdot S$ l/m³ | | | 419.2 | 573.2 | 639.4 | 705.7 | |
| $\Sigma = C_v + S_v + \alpha \cdot C + \beta \cdot S$ l/m³ | | 1000 | 982.1 | 958.3 | 925.8 | 863.7 | |
| $W_W = 1000 - \Sigma$ l/m³ | | | 17.9 | 41.7 | 74 | 136.3 | |
| $\Psi_{SW} = \left(1 - \frac{S}{\rho_{SD}}\right)100(\%)$ | | 100 | 40.4 | 18.5 | 9.1 | 0 | −3.64 |
| $\Psi_{SW} = \left(1 - \frac{S}{\rho_{SW}}\right)100(\%)$ | | 100 | 42.5 | 21.4 | 12.3 | 3.2 | 0 |

NOTE: $W_W$ contains air as well.

Apart from the sands shown in Tables 5 to 7, there were provided pit sand (4) from Kimitsu, Chiba having a FM value of 2.59, a true specific gravity of 2.55 and crushed sand (5) from Atsugi, Kanagawa having a FM value of 3.12 and a true specific gravity of 2.58. The percentage of water absorption according to JIS, the specific surface area, Sm, the percentage of adsorbed water, $\beta$, etc. on the fine aggregates (4) and (5) were summarized together with those on the fine aggregates (1) to (3) shown in Tables 5 to 7, and are shown in Table 8.

TABLE 8

| No. | Kind | Finess modulus coarse grain FM | Water absorption Q (%) | Specific gravity in absolute dry condition $\rho_s$ (g/cm³) | Specific surface area $S_m$ (cm²/g) | Unit weight in absolute dry condition $\rho_{SD}$ (kg/l) | Underwater unit weight $\rho_{SW}$ (kg/l) | Percentage of absorbed water $\beta$ (%) | Amt. of fine sand $M_{SV}$ (l/m³) | Percentage fine sand $M_S$ (%) | Porosity in absolute dry condition $\epsilon_{SD}$ (%) | Porosity under water $\epsilon_{SD}$ (%) |
|---|---|---|---|---|---|---|---|---|---|---|---|---|
| (1) | glass bead | 2.71 | 0.048 | 2.45 | 60.0 | 1.814 | 1.888 | 0.65 | 30.2 | 4.08 | 26.0 | 22.9 |
| (2) | Fuji reiver sand | 2.55 | 2.58 | 2.54 | 67.3 | 1.680 | 1.823 | 4.20 | 56.3 | 8.50 | 33.9 | 28.2 |
| (3) | Sagami crushed sand | 2.70 | 1.04 | 2.58 | 60.4 | 1.667 | 1.728 | 3.44 | 23.6 | 3.66 | 35.4 | 33.0 |
| (4) | Pit sand from Kimutsu | 2.59 | 1.61 | 2.55 | 53.5 | 1.720 | 1.854 | 2.81 | 52.5 | 7.80 | 32.5 | 27.3 |
| (5) | Atsugi crushed sand | 3.12 | 1.33 | 2.58 | 42.2 | 1.729 | 1.782 | 2.71 | 20.5 | 3.07 | 33.9 | 30.9 |

The fundamental amount of water per unit volume (Ww) necessary in the above-described underwater closest packed state besides the underwater weight per unit volume, $\rho_{SW}$, the percentage of underwater void ratio of powder and grain, $\psi_{SW}$, and the amount of sand in the formation of the underwater closest packed state (Sv), the amount of powder such as cement (Cv), the amount of water retained and adsorbed by sand ($\beta$s), and the amount of water retained and adsorbed by powder such as cement ($\alpha$, c) according to the present invention were determined on the above-described individual fine aggregate (4) and (5), and the results are shown in Table 9.

TABLE 9

| | Mortar (S/C) | $\rho_{SW}$ (kg/l) | $\Psi_{SW}$ (%) | Ww (l/m³) |
|---|---|---|---|---|
| (4) | S/C = 1.0 | 2.274 | 46.9 | 24.2 |
| | S/C = 2.0 | 2.282 | 27.4 | 46.8 |
| | S/C = 3.0 | 2.241 | 19.4 | 83.3 |
| | S/C = 6.0 | 2.162 | 11.4 | 147.2 |
| (5) | S/C = 0 | 2.190 | 100 | 14.0 |
| | S/C = 1 | 2.286 | 44.1 | 18.1 |
| | S/C = 3 | 2.297 | 13.0 | 54.9 |
| | S/C = 6 | 2.219 | 5.4 | 131.0 |

As opposed to the above-described closest packing under water, a closest packing in absolute dry condition similar thereto is a closest packed material in absolute dry condition, and the weight per unit volume, $\rho_{SD}$, and percentage looseness, $\psi_{SD}$, are similarly determined. These values are shown as the absolute dry bulk specific gravity, $\rho_{SD}$, and the percentage absolute dry looseness, $\psi_{SD}$, in Tables 5 to 7. The $\rho_{SD}$ and $\psi_{SD}$ are lower than the underwater bulk specific gravity, $\rho_{SW}$, or percentage underwater looseness, $\psi_{SW}$.

FIG. 1 is a phase diagram showing the relationships of the unit amount of water (W), Cv, Sv, the percentage underwater looseness, $\psi_{SW}$, the fundamental unit amount of water ($W_W$), the weight per unit volume ($\rho_{SW}$ and $\rho_{SD}$), the amount of flowable particulate component per unit volume (Ms), etc. on an underwater closest packed material as described above prepared from a mixture comprising the above-described fine aggregate (1) and ordinary Portland cement as a powder. Thus, the phase diagram enables the relationship of factors in the mixture to be properly elucidated. Similarly, a phase diagram can be prepared also on the fine grains (2) to (5) for elucidation of the above-described relationships.

Regarding the fine granular material (1) artificially prepared for reference, there were provided those wherein grains respectively having sizes of 0.15 mm or less, 0.3 mm or less and 0.6 mm or less were cut off, and the weight per unit volume in absolute dry condition, $\rho_{SD}$, and the underwater weight per unit volume, $\rho_{SW}$, were determined on these fine grains. The results were summarized together with the original sand and are shown in FIG. 2. In the fine grain (1) which is an artificially prepared product and free from pore, the underwater weight per unit volume, $\rho_{SW}$, is higher than the weight per unit volume in absolute dry condition, $\rho_{SD}$, in any grain size. This showed that the underwater weight per unit volume, $\rho_{SW}$, is clearly different from the above-described $\rho_{SD}$.

It is possible to predict the mix proportion as follows. The unit amount of the fine grain [$M_{SV}$: $(\rho_{SW}-\rho_{SD})/\rho_S\times 1000$] is determined on the above-described fine grains (1) to (5), and the mix proportion is predicted by the following equation through the use of the functions thereof, K, k, and the relationship of the percentage underwater looseness, $\psi_{SW}$, with the fundamental unit amount of water, $W_W$:

$$W_W = K\cdot\psi_{SW}^{k}.$$

It has been confirmed that the value determined by the above-described prediction of mix proportion is substantially in agreement with the results in the case where a mixture was actually prepared and measured. The values of the above-described functions, K, k, in the case of the above-described equation which have actually been determined on the above-described fine grains (1) to (5) are shown in Table 10.

TABLE 10

| | | |
|---|---|---|
| (1) | K = 502.6 | k = −0.69 |
| (2) | K = 4717.7 | k = −1.44 |
| (3) | K = 472.6 | k = −0.80 |
| (4) | K = 3697.3 | k = −1.21 |
| (5) | K = 602.9 | k = −0.89 |

As described above, the $W_W$ value can be predicted by properly conducting a material test of the fine aggregate and using the measured values of $\beta$ and $M_{SV}$ of the grain. Further, since $W_W = 1000 - C_V + S_V + \alpha\cdot C + \beta\cdot S$, as shown in FIG. 1, the mix proportion of the closest packing can be determined from the above-described relationships.

Figure 3:
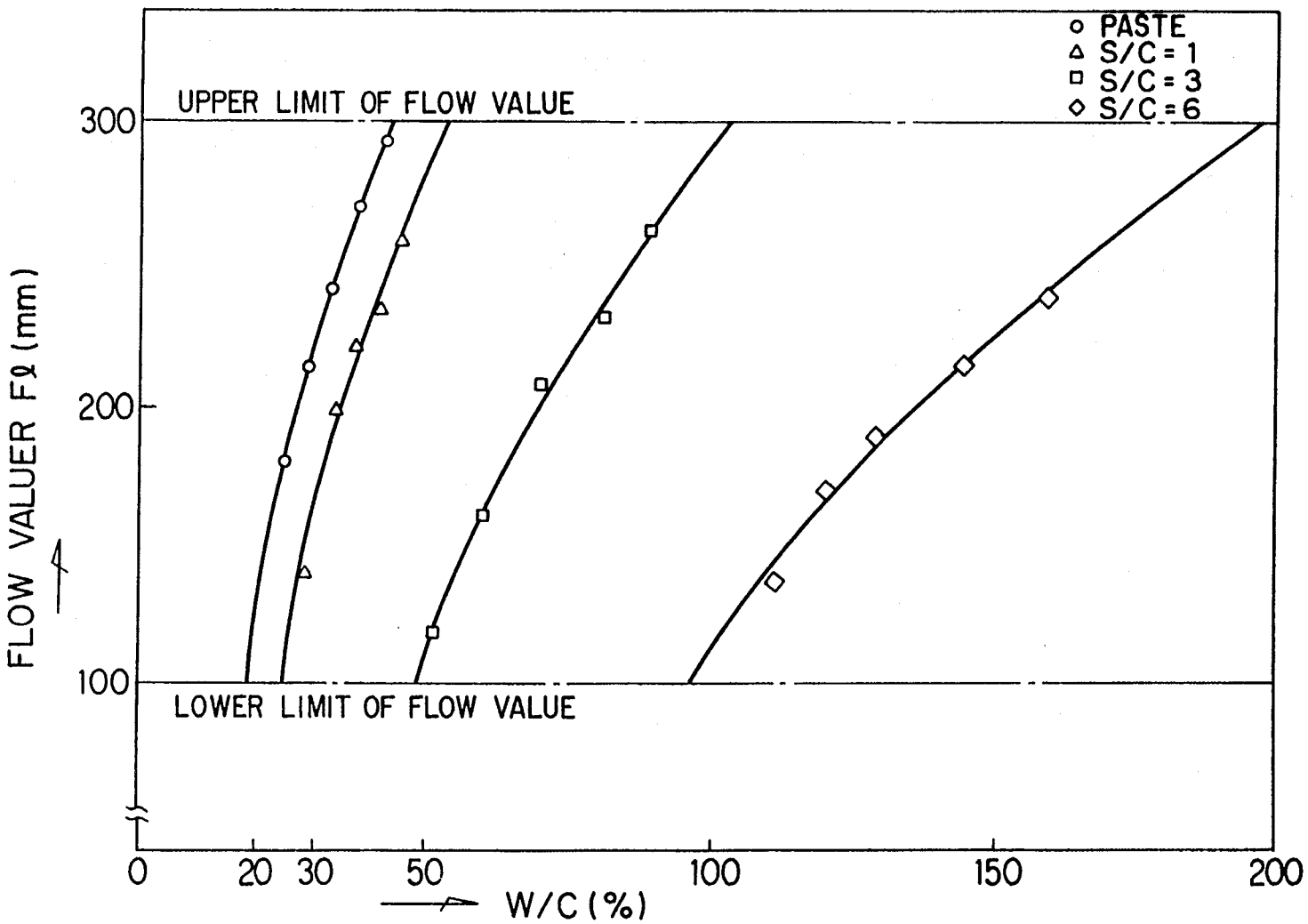
FIG. 3 is a diagram showing the relationship between the water to cement ratio by weight (W/C) and the flow value (F l: mm) on Atsugi crushed sand mortar including a paste made of an ordinary Portland cement.

The flow value according to JIS and W/C on mortars prepared by blending the above-described fine grain (5) with a ordinary Portland cement were specifically measured on a paste and those having an S/C value of 1 to 6. The results were summarized and shown in FIG. 3. The higher the W/C value, the higher the flow value. The state of the change forms a curve on a diagram. Similarly, a curve is formed also on other fine aggregates (1) to (4). However, it is a matter of course that the state of change varies depending upon the properties the fine aggregates. Accordingly, the present inventors have studied on the prediction and analysis of the behavior of concrete mixed and kneaded products based on the results shown in FIG. 3. However, due to the curve as shown in FIG. 3, the prediction and analysis were very complicate even when modern computers were used. This leads to a great possibility of producing errors, so that the precision becomes poor.

For this reason, the present inventors have made further studies. Specifically, in the study of the relationship between the results of the flow test and the W/C, the relationship between the flow area and the water to cement ratio (W/C) was studied by taking into consideration the fact that the actual flow phenomenon is developed in terms of the area on a flow table. As a result, it has been found that this method provides results favorable for the analysis. Specifically, the flow area (SFl) is determined from the major axis and minor axis at the time of the flow test and can be expressed by the following general equation VI:

$$SFl = \left(\frac{Fl}{2}\right)^2 \times \pi \qquad \text{VI}$$

In the flow test wherein use was made of Atsugi crushed sand exhibiting the results shown in FIG. 3, the flow area (S F l) was used instead of the flow value (Fl), and the results are shown in FIG. 4. It has been confirmed that an exact straight line can be obtained in any case where the S/C values are 0, 1, 3 and 6. That is, it has been confirmed that, as given in the above-described equation VI, the flow area is proportional to the second powder of the flow value obtained when the S/C value is made constant with a variation in the W/C value. Although the above results are for Atsugi crushed sand (5) as a representative example, it is a matter of course that this is also true of other fine grains (1) to (4).

In connection with the results shown in FIG. 4, even when the S/C is varied to various values, the relationship between the SFl value and the W/C value can be easily and properly determined from the results shown in the diagram. Specifically, the relationship between the SFl ($cm^2$) value and the W/C value (%) is a linear relationship where the S/C is a function, and represented by the following general equation VII as an equation for a straight line:

$$SFl = -A + B^{S/C} \qquad \text{VII}$$

This will be described in more detail. As described above, the relationship between the flow value (mm) and the W/C is expressed in a curve on a diagram. Therefore, in order to determine a curvature (or a curve) on a certain mixture with a constant S/C value, as shown in FIG. 3, it is necessary to provide at least four samples for the same S/C value, to test the sample and then to plot the results. Further, in a different S/C value, the results cannot lightly be predicted. Therefore, in this case, the behavior of the mixture cannot be grasped without testing a large amount of sample in each case. Therefore, this is apparently complicate, and in fact, it is impossible to conduct a proper prediction. By contrast, as shown in FIG. 4, when the relationship is linear, a straight line for the first S/C value can be determined by merely plotting two measured values. Then, the W/C value is varied in a sample having the second S/C value different from the first S/C value, and similarly two measured values are plotted to obtain the second straight line. When calculation is conducted from the relationship between the first S/C value and the second S/C value by making use of S/C as a function according to the above-described equation VII, it is possible to determine the relationship between the SFl value and the W/C value even in any S/C value. Finally, the whole behavior of the mixture can be elucidated and predicted by plotting four points. In other words, that the whole aspect of the SFl value and W/C value in the above-described mixture can be grasped, elucidated and properly determined through the measurements of about four points is a very large reform in view of the conventional technical concept in this field, and the significance or the effect is remarkably large.

Specifically, as shown in the following Table 11, the Fl value was measured on mortars wherein the S/C values were 1 and 3 the W/C value was varied. The SFl value was calculated therefrom. Then, calculation was conducted by the above-described equation VII through the use of the determined S Fl. As a result, experimental constants in SFl=−A+B·S/C were as follows.

$$A=438.9\ e^{0.031S/C}$$

$$B=20.9-8.4\ \log e\ S/C$$

TABLE 11

| S/C | W/C | Fl | SFl |
|---|---|---|---|
| 1 | 30 | 151 | 179 |
| | 40 | 221 | 384 |
| 3 | 70 | 208 | 340 |
| | 90 | 269 | 568 |

Figure 5:
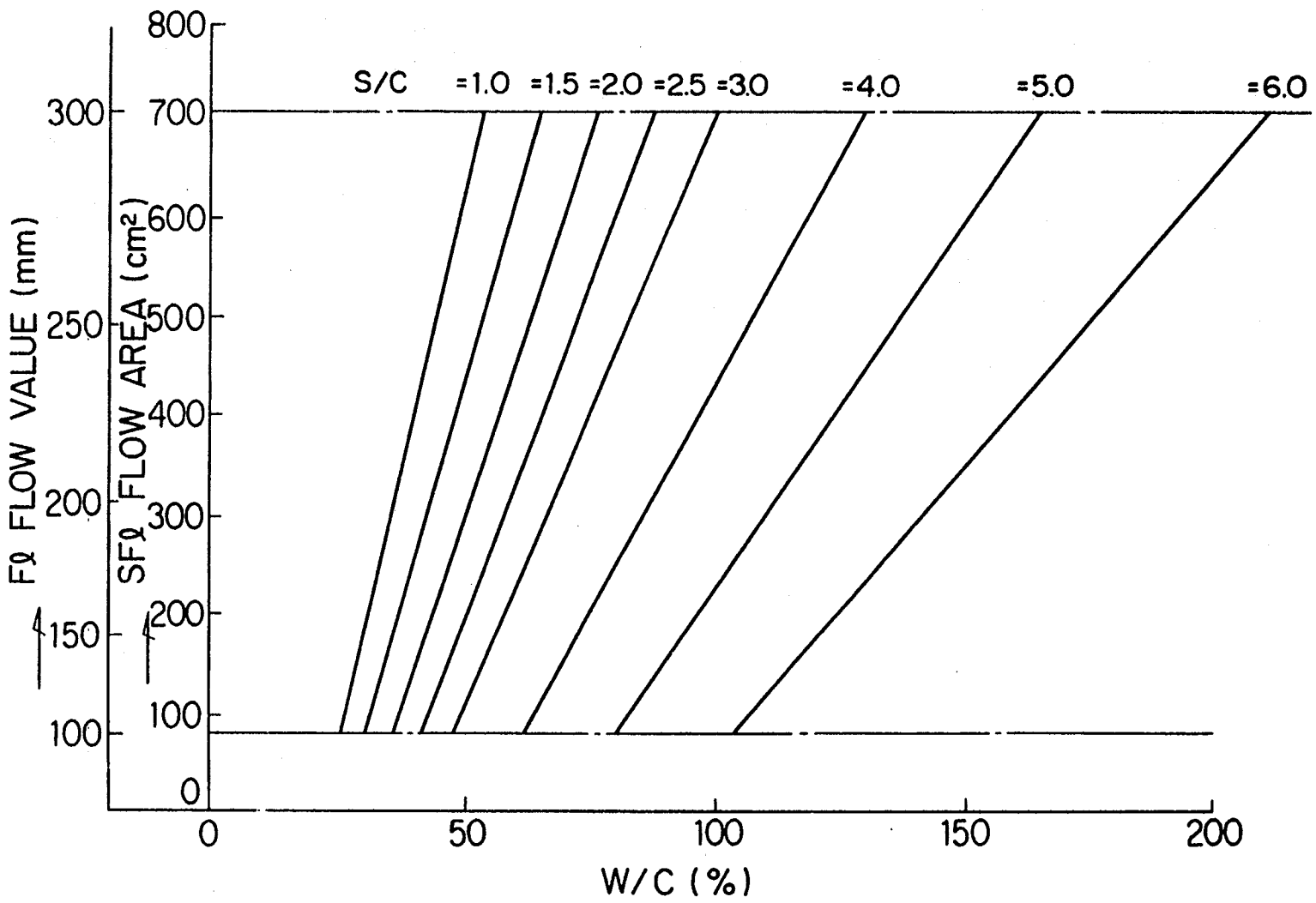
FIG. 5 is a diagram showing the relationship between the flow area and flow value and the W/C with various S/C values on Atsugi crushed sand mortar.

When the above-described A and B are calculated, as shown in FIG. 5, there is obtained the relationship between a given W/C value and W/C·SFl, which enables the relationship between the mix proportion of the mortar and the fluidity to be easily predicted, so that the elucidation can properly be made. The mortar for four point test as shown in Table 11 may be a mortar prepared for the test of a percentage of relative retaining water ($\beta$) of the fine aggregate. This enables the preparation of the sample to be rationalized. The above-described liner relationship can be similarly determined by a regression equation wherein the specific surface area ($S_m$) and the amount of the fine sand ($M_{sv}$) of the granular material are each functions. Specifically, the relationship represented by the following equation VIII is obtained when the relationship between the flow area (SFl) and the W/C is determined on mortar comprising a combined and kneaded pit sand from Kimitsu (4):

$$SFl=-A+B\cdot(W-\beta\cdot S)/C \qquad \text{VIII}$$

Then, when the results obtained by calculation according to the equation VIII wherein the specific surface area, Sm, and $M_{sv}$ are each a function, are compared with the measured values, the relationships on the terms A and B are as follows and the theoretical equation is substantially in agreement with the actual equation:

| Theoretical equation | Actual equation |
|---|---|
| $A = 279.0 \cdot e^{0.104 \cdot S/C}$ | $A = 291.6 \cdot e^{0.126 \cdot S/C}$ |
| $B = 20.6 - 5.33 \cdot \log S/C$ | $B = 18.7 - 5.28 \cdot \log S/C$ |

Therefore, the relationship between the flow of the mortar comprising the fine grain and the (W−B·S)/C can be predicted through the actual measurement of $\beta$, Sm and $M_{sv}$ values of a fine grain such as sand, and the mix proportion is predicted and determined from the S/C obtained at that time.

Figure 6:
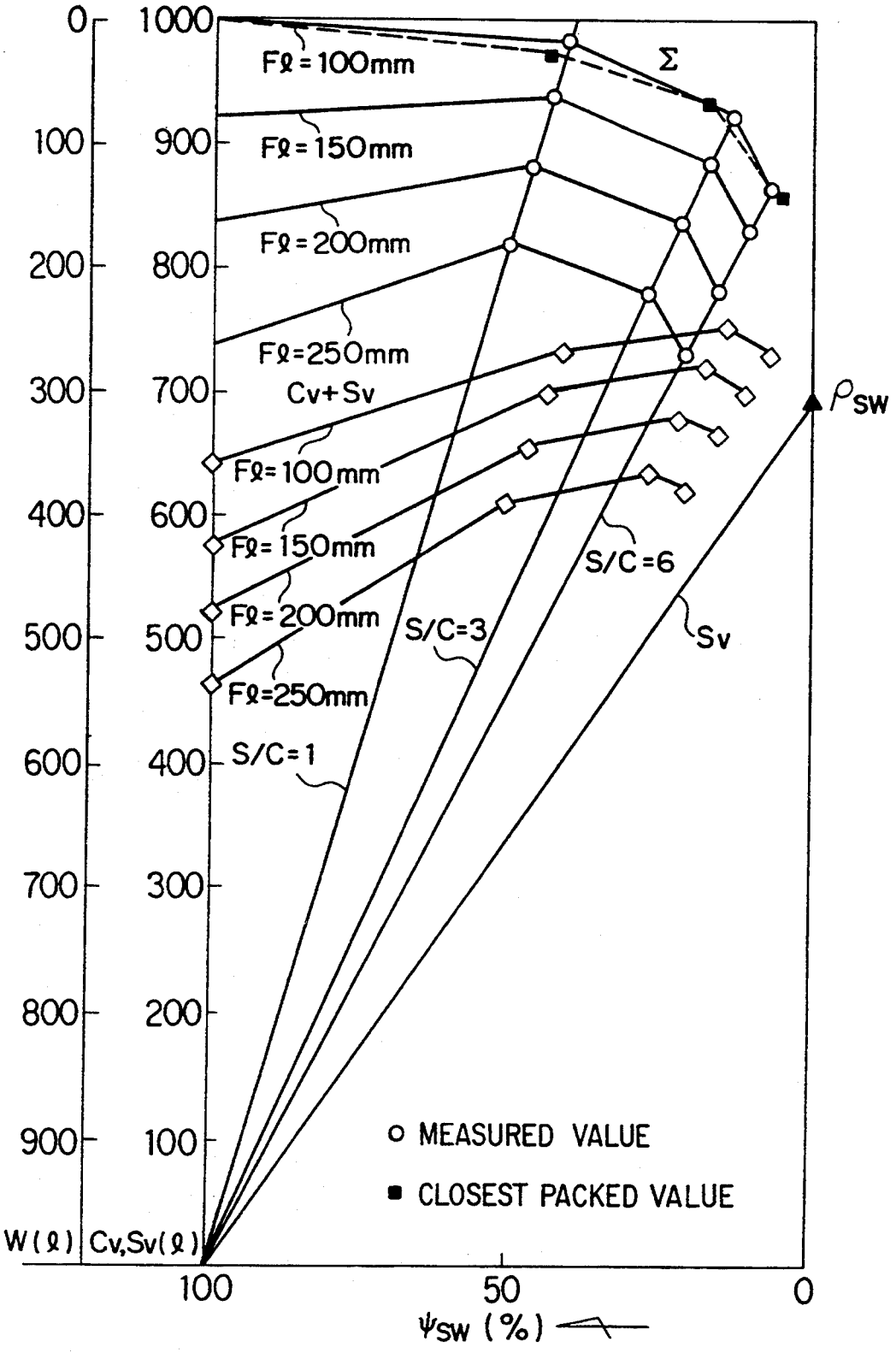
FIG. 6 is a diagram analytically showing a mixing phase on a mortar wherein Atsugi crushed sand and an ordinary Portland cement are used.

FIG. 6 shows the theoretical mixing proportion of mortar similar to FIG. 1 in the case where the above-described Atsugi crushed sand (5) and normal portland cement are used. When the W/C value of the paste in a flow value of 100 mm (critical value in the measurement of the flow) is $\alpha$F, the $\alpha$F is the intersection of the straight line (0: measured value) of the paste and the dashed line on a Fl value of 100 mm in the above-described FIG. 4. Specifically, the W/C value is 19%. $\alpha$ is the W/C in the maximum torque in the case where water is added to and kneaded with an ordinary Portland cement and W/C of the paste (S/C=0) in the above-described Tables 5 to 7. In this case, the value is about 25%. Further, the percentage of adsorbed water $\beta$=2.71 (see (5) in the above-described Table 8) on this fine grain (5) is a value obtained by allowing a centrifugal force capable of stabilizing the $\beta$ value, i.e., about 100 to 500 G or more, to be applied. On the other hand, $\beta$F is a value wherein the mixing energy of the used mixer has been converted into a centrifugal force. In this case, $\beta$F is about 1.8 and $\beta$ is 4.88 which corresponds to a centrifugal force of 20 to 30 G.

In the mixture shown in the above-described FIG. 4, the measured values in a flow value (Fl) from 100 mm to 250 mm are as shown by an open circle. In this case, the Σ point in Fl=100 mm is taken as $\alpha$=19% and $\beta$=4.88%. This is optimal $W_1$/C (percentage optimal primary kneading water) in the composite kneading (double mixing: sand enveloped with cement) developed by the present inventors and represented by the following equation IX:

$$W_1/C=19+4.88\ S/C \qquad \text{IX}$$

In order to prepare a mortar having an intended flow value (e.g., 150 mm) through addition of secondary water to a mortar subjected to primary kneading in the optimal $W_1$/C value, water corresponding to the difference in S/C value in a constant flow line of (150 mm) parallel to the W/C axis in FIG. 5 may added and mixed. The measured values indicated by closed square (■) in FIG. 6 is (1000−Ww) in a closest packed mortar having an S/C value of 1.3. 6. wherein use is made of Atsugi crushed sand having an a value of 25% and $\beta$ value of 2.71 and represented by the following equations X and XI. As described above, a corresponds to the maximum mixed torque of paste.

$$\Sigma=1000-W_w=C_v+S_v+\alpha\cdot C+\beta\cdot S \qquad \text{X}$$

$$W_1=\Sigma-(C_v+S_v)=\alpha\cdot C+\beta\cdot S \quad \text{XI}$$

Division of both terms of the above-described equation XI by C gives the following equation.

$$W_1/C=\alpha+\beta S/C=25+2.71\ S/C$$

The optimal W1/C in the composite kneading (SEC) may be determined by any of the above methods. In order to obtain a predetermined flow value in FIG. 6, however, the $\alpha$·F value should be used. When the a value is used, it is necessary to convert the $\alpha$F and $\beta$F values.

Figure 7:
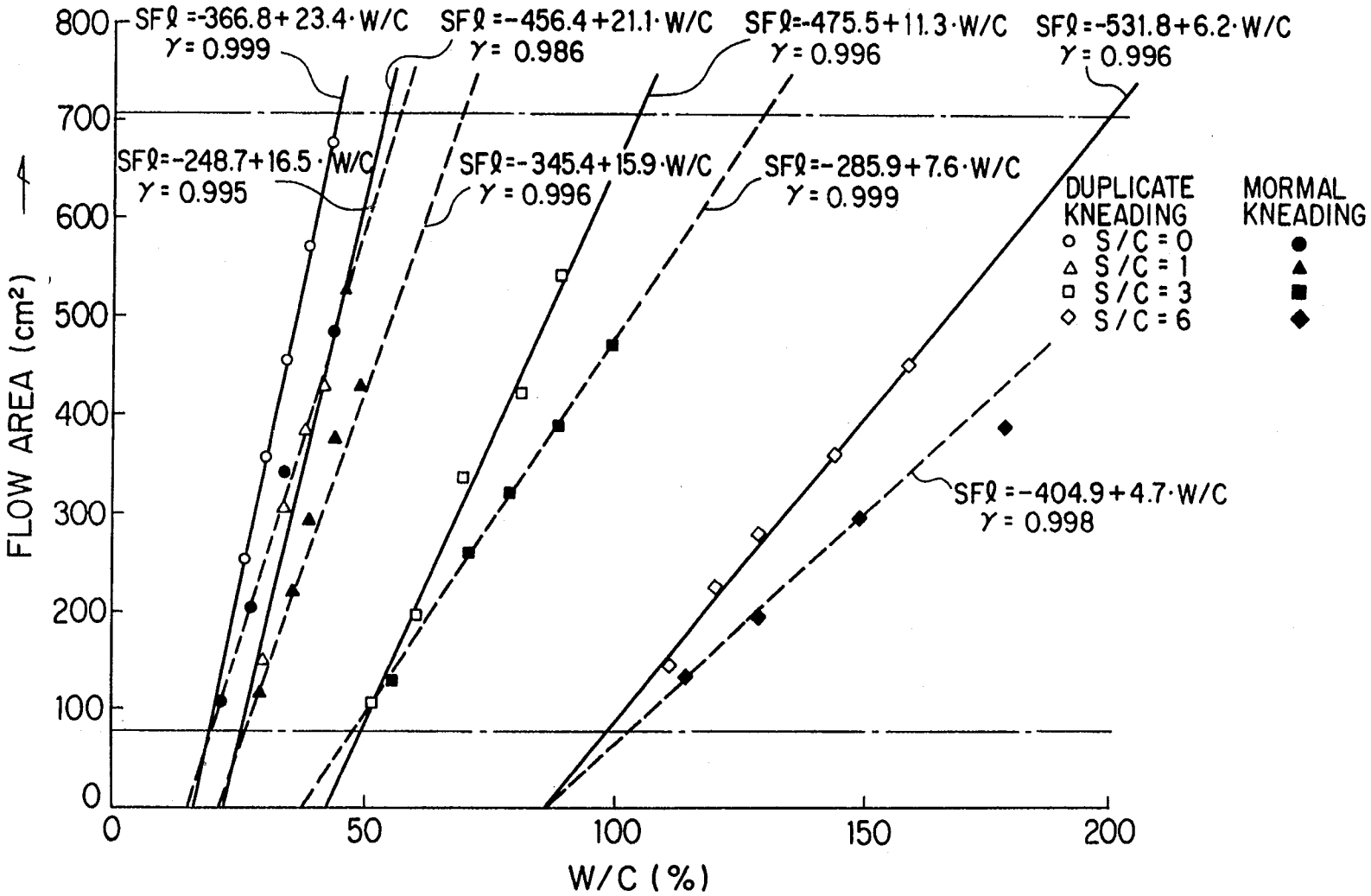
FIG. 7 is a diagram showing the relationship between the W/C and the flow area on Atsugi crushed sand wherein duplicate kneading is shown in comparison with normal kneading (single kneading)

In FIG. 7, the relationship between the SFl (flow area) and the W/C as shown in FIG. 4 is shown on both the composite kneading (SEC method) proposed by the present inventors and the normal kneading. The precision ($\gamma$) is as high as 0.98 or more. Even in the case of mixtures having the same or substantially the same W/C value, the measured values of the fluidity (SFl) of the mixture prepared by the composite kneading indicated by an open circle are always higher than those in the case of the normal kneading and the difference in the fluidity is obvious. It has been confirmed that the mortar prepared by the composite kneading is superior also in the strength and other properties as shown in FIG. 7.

As described above, the relationship shown in FIG. 7 can be easily elucidated by providing a graph as shown in FIG. 5, properly developing the relationship as a linear equation represented by the equation VII and obtaining at least four measured values. In any kneaded product (mixture), the properties can be predicted and determined, and the mixing proportion can be determined.

Figure 8:
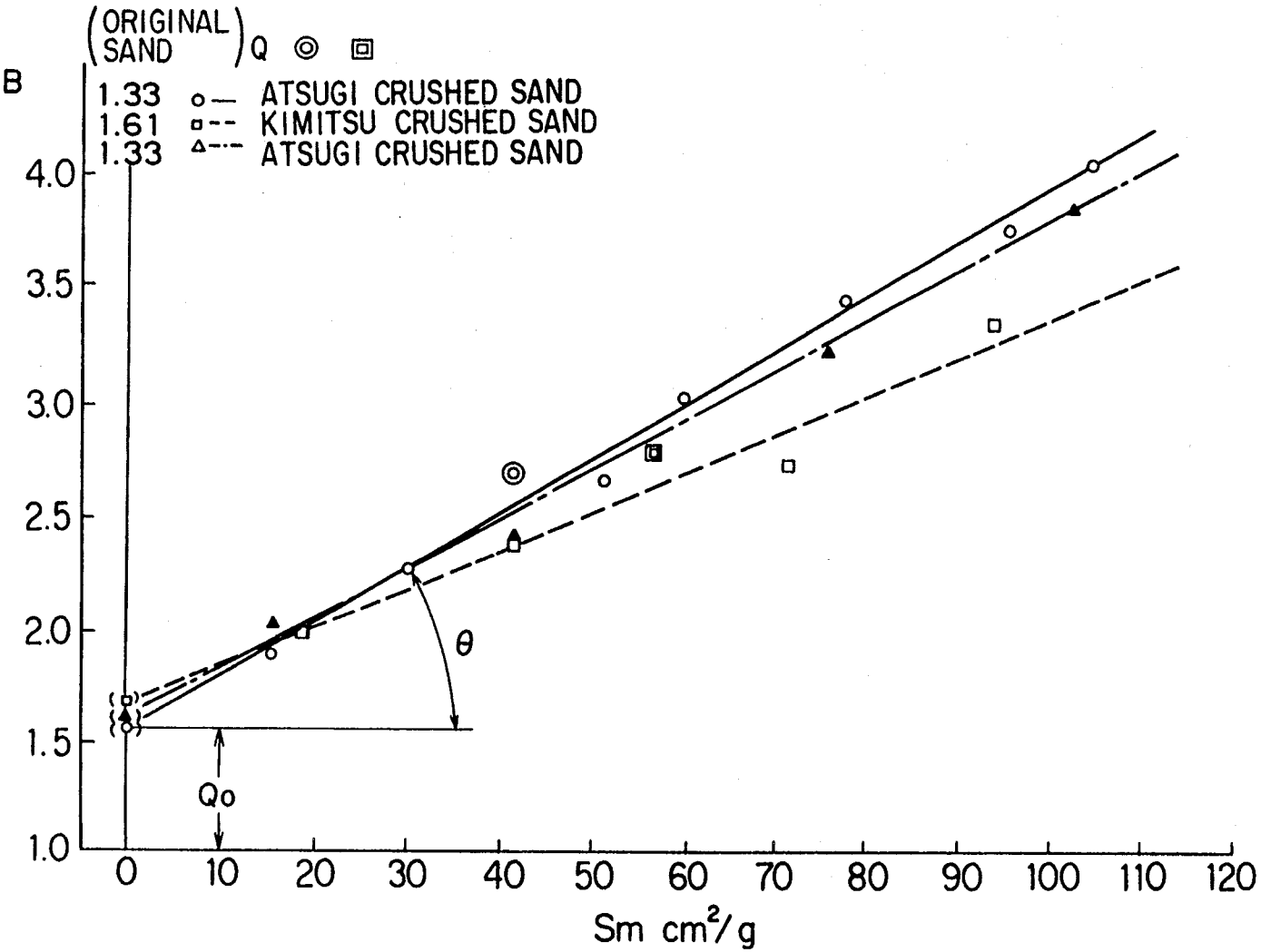
FIG. 8 is a diagram on various mixed sands showing the relationship between the specific surface area, $S_m$, and the percentage of relative retaining water, $\beta$, after dehydration at a centrifugal force of 438 G for 30 min.

Regarding mortars (measured values being indicated in an open form) prepared by adding and mixing a normal portland cement with the above-described Atsugi crushed sand (5) and Kimitsu pit sand (4) and mortars (measured values being indicated in a solid form) prepared by adding and mixing fly ash to Atsugi crushed sand, the size distribution of each of the fine grains (4) and (5) (the specific surface area, Sm, in the original sands was 53.5 $cm^2/g$ for (4) and 42.2 $cm^2/g$ for (5) as shown in Table 8) was regulated, and they were subjected to a stabilized dehydration treatment wherein no lowering in the amount of residual water, $\beta$, is observed even when the centrifugal force, G, is increased. The results were summarized and are shown in FIG. 8 showing the relationship between the specific surface area (Sm) and the percentage of residual relative retaining water, $\beta$. It has been confirmed that the increase in the $\beta$ value with an increase in the Sm value is expressed by a substantially exact straight line on this diagram. In FIG. 8, the straight lines obtained by the above-described method were extended as they were, and the intersection of the straight lines and the zero axis of the specific surface area, Sm, were indicated by putting the measured values in parentheses. The $\beta$ values in the intersection of the zero axis of the specific surface area are those obtained independently of the specific surface area, Sm, of the fine grains (4) and (5) and can be regarded as a true water absorption value, $Q_0$, in the fine grains. The angle, $\theta$, of a straight line drawn parallel to the axis of abscissa from the percentage true water absorption, $Q_0$, to a straight line of the $\beta$ value which increases with an increase in the Sm value varies depending upon the fine grain or powder, and tan $\theta$ is the percentage of surface adsorbed water inherent in the fine grains.

When the results shown in FIG. 8 are studied, as shown in the above Table 8, the percentage of absorbed water values, Q, according to JIS on the above-described fine aggregates (4) and (5) are 1.61% and 1.33%, respectively. The percentage true water absorption, $Q_0$, according to the present invention is clearly different from and higher than the percentage water absorption, Q, according to JIS. The difference between Q and $Q_0$ varies depending upon the fine grains, and the difference on the fine aggregate (4) is larger than that on the fine aggregate (5). This is believed to derive from the difference in the texture of the natural fine grains. In any way, it is apparent that the percentage water absorption, $Q_0$, determined at a point where the specific surface area, Sm, is zero is more accurate than the percentage water absorption, Q, according to JIS which is determined by breaking of a flow cone. The use of the percentage true water absorption, $Q_0$, enables the properties of each kneaded product to be accurately predicted and estimated, so that the mix proportion can rationally determined. The percentage water absorption, $\beta_0$, not related to the specific surface area, Sm, is the percentage water within the texture of the fine granular material and water not related to the fluidity and strength of the mixture prepared by making use of the fine granular material. Therefore, as with the percentage of water absorption prescribed in JIS, the $Q_0$ value can be handled in the same manner as that in the case of the specific gravity in saturated surface dry condition wherein the amount of water absorbed without increasing the volume of the aggregate is regarded as an increase in the weight. On the other hand, the percentage of water absorption obtained by tan$\theta$ is the percentage of relative surface adsorbed water, and this water apparently has an effect on the fluidity and strength of the mixture. When the measured specific surface area of the fine aggregate is Sm, the percentage of surface adsorbed water of the fine aggregate is tan$\theta\times$Sm. Therefore, the percentage of relative holding water, $\beta$, can be expressed by the following equation:

$$\beta=Q_0+\tan\theta\cdot Sm$$

Even when the percentage of relative holding water, $\beta$, is a stable one which does not vary even when the dehydration treatment is conducted by means of a centrifugal force exceeding a predetermined value, the determination of the above-described $Q_0$ value followed by analysis to determine the mix proportion enables the prediction and design to be properly conducted.

Regarding the mortar prepared by the normal kneading wherein use was made of the above-described Atsugi crushed sand (5), the relationship between the amount of water and the fluidity (flow) was studied on mortars having S/C values of 1, 3 and 6 wherein the amount of constrained water, $\beta$·S, of the above-described fine aggregate, the above-described percentage of water absorption, $Q_0$, according to the present invention shown in FIG. 8 and as described above and a mere water to cement ratio (W/C) commonly used in the art were used for the amount of water. The results are shown in Table 12. The coefficient of variation according to mere W/C is 18.5%. By contrast, the coefficients of variation according to $\beta$·S and $Q_0$·S are remarkably lowered and 12.5% and 10.6%, respectively.

TABLE 12

| S/C | Relationship between (W − β · S)/C and flow | Relationship between (W − Q0 · S)/C and flow | Relationship between W/C and flow |
|---|---|---|---|
| 1 | SFl = −288.5 + 15.9 · (W − β · S)/C γ = 0.996 | SFl = −319.6 + 15.9 · (W − Q0 · S)/C γ = 0.996 | SFl = −345.4 + 15.9 · W/C γ = 0.996 |
| 2 | SFl = −204.0 + 7.6 · (W − β · S)/C γ = 0.999 | SFl = −248.9 + 7.6 · (W − Q0 · S)/C γ = 0.999 | SFl = −285.9 + 7.6 · W/C γ = 0.999 |
| 3 | SFl = −233.0 + 4.0 · (W − β · S)/C γ = 0.996 first term average = 243.6 coefficient of variation = 12.5% | SFl = −280.5 + 4.0 · (W − Q0 · S)/C γ = 0.996 first term average = 274.4 coefficient of variation = 10.6% | SFl = −404.9 + 4.7 · W/C γ = 0.996 first term average = 321.2 coefficient of variation = 18.5% |

As with Table 12, various mortars prepared by making use of the Atsugi crushed sand (5) according to the above-described composite kneading method (which comprises equally attaching primary water to the fine aggregate, adding and mixing a cement powder with the fine aggregate and then adding the remaining water and again conducting mixing to prepare a kneaded product having an intended water content) were studied on the fluidity through the use of β·S and Q0 and W/C. The results are shown in Table 13. In this case, the coefficient of variation is 13.0% even in the case of W/C, i.e., considerably lower than the case of Table 12, and lowered to 4.3% and 8.8% respectively in the case of β·S and Q0.

TABLE 13

| S/C | Relationship between (W − β · S)/C and flow | Relationship between (W − Q0 · S)/C and flow | Relationship between W/C and flow |
|---|---|---|---|
| 1 | SFl = −380.3 + 21.1 · (W − β · S)/C γ = 0.985 | SFl = −422.6 + 21.1 · (W − Q0 · S)/C γ = 0.986 | SFl = −456.4 + 21.1 · W/C γ = 0.986 |
| 3 | SFl = −354.9 + 11.3 · (W − β · S)/C γ = 0.996 | SFl = −420.2 + 11.3 · (W − Q0 · S)/C γ = 0.996 | SFl = −475.5 + 11.3 · W/C γ = 0.996 |
| 6 | SFl = −397.9 + 6.2 · (W − β · S)/C γ = 0.996 first term average = 375.0 coefficient of variation = 4.3% | SFl = −471.4 + 6.2 · (W − Q0 · S)/C γ = 0.996 first term average = 420.3 coefficient of variation = 8.8% | SFl = −531.8 + 6.2 · W/C γ = 0.996 first term average = 457.6 coefficient of variation = 13.0% |

When the results of the above-described Tables 12 and 13 are studied, it is apparent that the coefficient in the case of the normal kneading method is lower than that in the case of the composite method. However, when β·S and Q0·S are used, the Q0·S exhibits the lowest coefficient of variation in the case of the normal kneading method. On the other hand, in the case of the composite kneading method, the β·S exhibits a coefficient of variation as low as 4.3% while the Q0·S exhibits a considerably high value of 8.8% (although this value is lower than that in the case of the normal kneading). In other words, the type of amount of water which provides the lowest coefficient of variation varies depending upon the kneading method. It was true of the case where other fine aggregates (1) to (4) were used. Specifically, in the case of the normal kneading, the percentage true water absorption, Q0, is vary important and has a great effect on the coefficient of variation due to the kneading conditions. On the other hand, in the composite kneading, a stable cement coating is formed around the fine aggregate, so that the coefficient of variation is governed by the amount of water constrained around the fine aggregate. Therefore, in the present invention, either β·S or Q0·S is used depending upon the kneading method. The present invention was actually applied to many mortars according to the normal kneading method and the composite kneading, and the results were as shown in Tables 12 and 13. Specifically, mortars having a low coefficient of variation could be prepared through the use of Q0·S in the case of the normal kneading and β·S in the case of the composite kneading.

Figure 9:
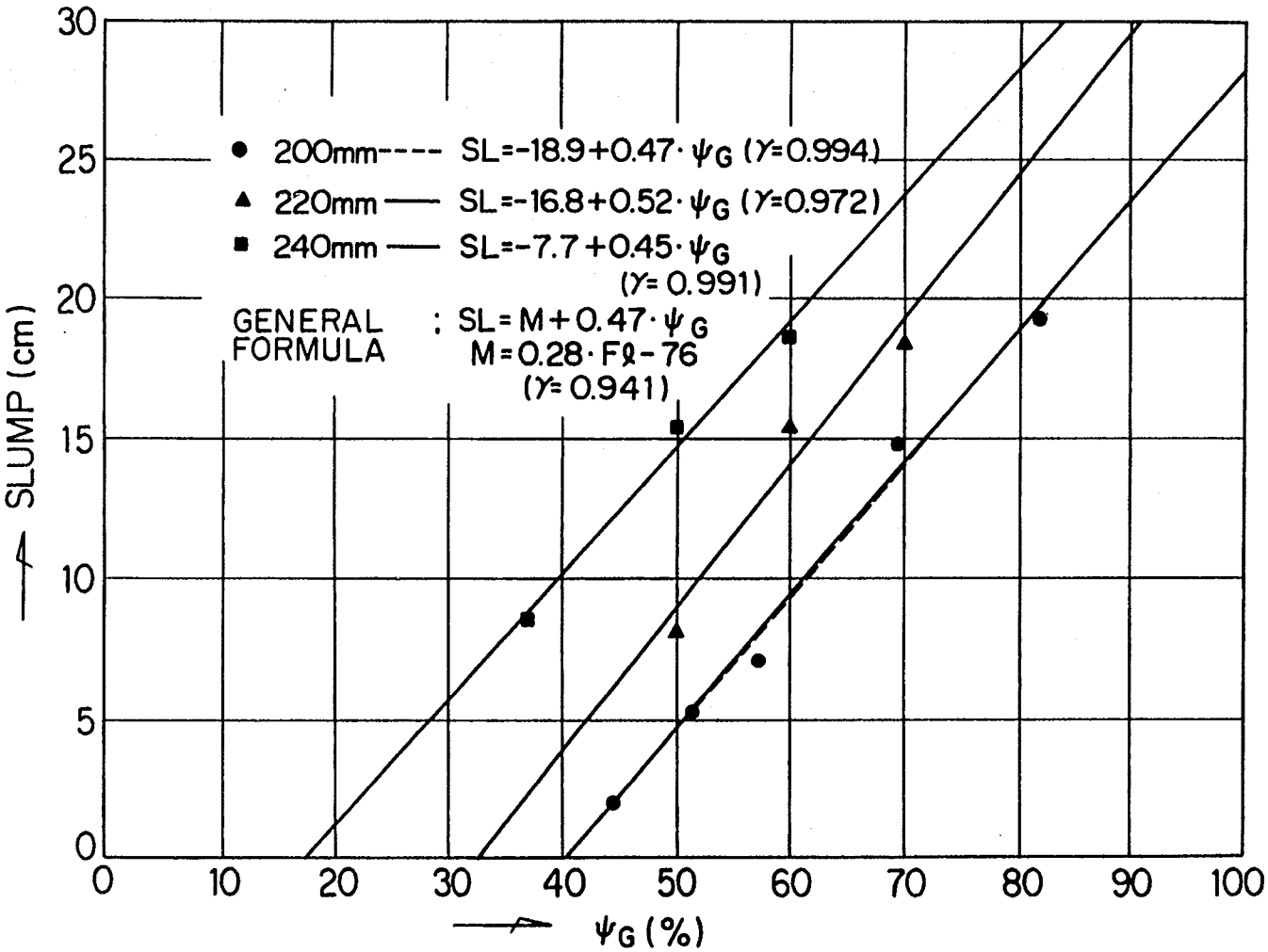
FIG. 9 is a diagram showing the relationship between the percentage of coarse aggregate loosening, $\psi_G$ a and the slump value, SL, in the case of various flow values on a concrete wherein use is made of Atsugi crushed sand mortar.

FIG. 9 shows the relationship between the void ratio of coarse aggregate, ψG (it is a matter of course that the reciprocal thereof is the percentage coarse aggregate packing), and the slump value (SL: cm) in terms of the flow value of the mortar on the concrete wherein use was made of a mortar comprising the above-described Atsugi crushed sand (5). Specifically, the slump value in this case (SL) is determined by the following general formula X II, and as shown in the drawing, the relationship between the ψG and the slump value is expressed by a straight line on a rectangular coordinate.

$$SL = M + 0.47 \cdot \psi_G G \qquad \text{XII}$$

$$M = 0.28 \cdot Fl - 76$$

It is apparent from FIG. 9 that when a mixture such as concrete of mortar consisting of sand, granular slag, artificial fine aggregate or other similar granular material and, mixed therewith, powder such as cement, fly ash or powdery slag, water or other liquid is prepared, the mix proportion of concrete can be determined by any fluidity (slump) and W/C if the amount of the coarse aggregate from the optimal s/a (sand to coarse aggregate ratio) or clogging property, separation, profitability, etc. to determine the void ratio of coarse aggregate, ψG. Specifically, if the amount of the coarse aggregate is determined from the optimal s/a or clogging, separation, profitability, etc. by taking into consideration the amount and grain size distribution of the coarse aggregate, the void ratio of coarse aggregate, ψG, in a concrete wherein the coarse aggregate is used in the above amount is determined. Then, a preferred mix proportion for the concrete is rationally and properly determined based on the W/C derived from preferred slump value and intended strength for the void ratio of coarse aggregate, ψG.

In fact, when a concrete was prepared in the mix proportion thus determined and deposited, the precision was very high and 0.92 to 0.98 based on the intended compression strength.

Figure 10:
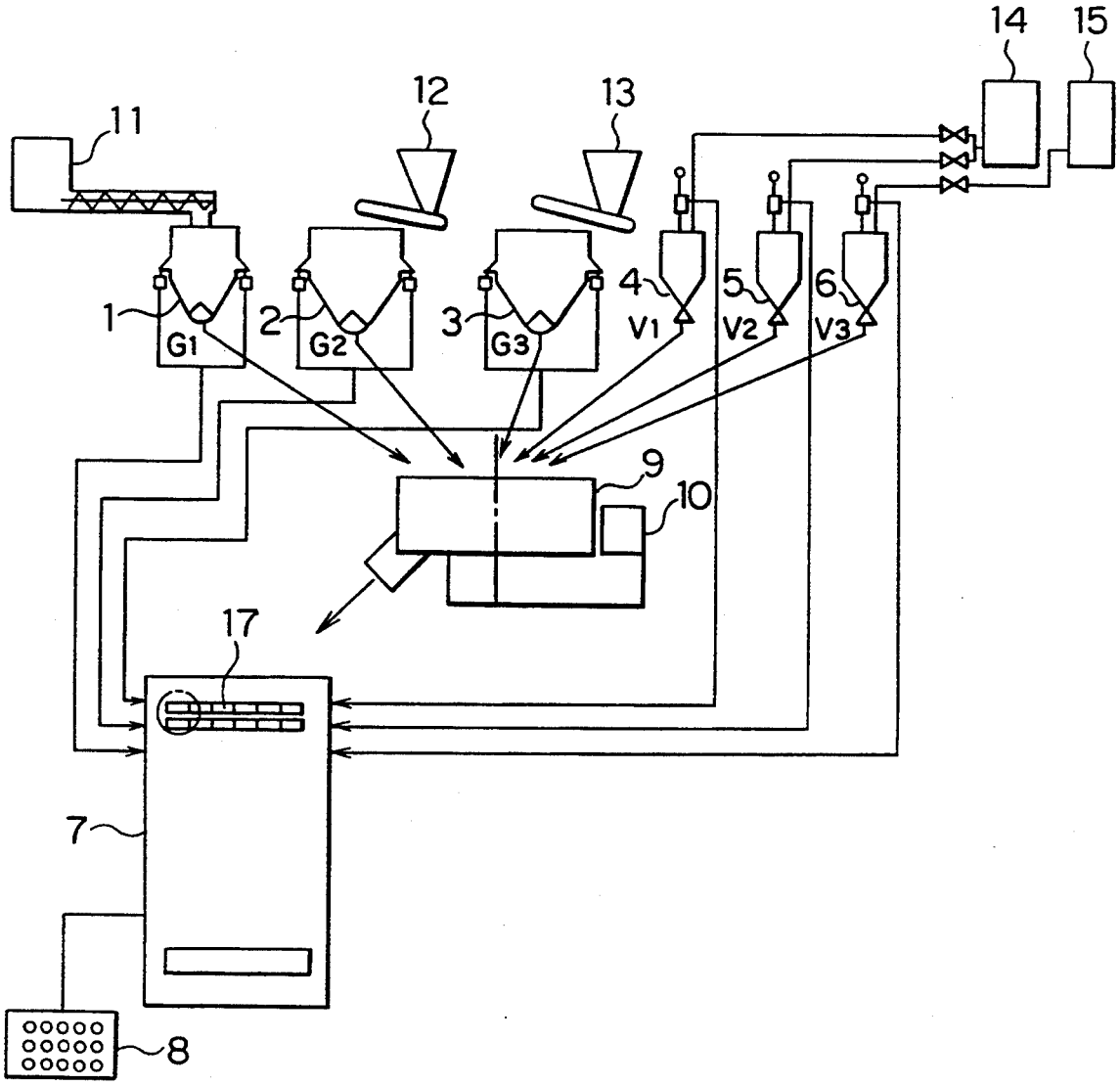
FIG. 10 is an illustrative view showing a general constitution of the apparatus according to the present invention.

FIG. 10 is a schematic view of an example of the equipment for specifically preparing a mixture based on the measured values or determined values. Specifically, the equipment is constructed so that materials are supplied to a mixer 9 from a cement measuring hopper 1, a fine aggregate measuring hopper 2, a coarse aggregate measuring hopper 3, a first water measuring tank 4, a second water measuring tank 5, and a water reducing admixture measuring tank 6. Individual materials are supplied and measured in the hoppers 1 to 3 or measuring tanks 4 to 6 from storage tanks 11 to 13 and supply sources 14 and 15. Signals from sensors 1*a* to 6*a* mounted on the hoppers 1 to 3 and measuring tanks 4 to 6 are transmitted to a control panel 7. A set value is input from setting section 8 into the control panel 7 and displayed, e.g., on the lower part of a display portion 17. When the signal obtained by the above-described supply and measuring conforms to this set value, the supply of the material from the storage tanks 11 to 13 or supply sources 14 and 15 stops. The mixer 9 is provided with a motor 10, receives the materials from the above-described hoppers 1 to 3 or measuring tanks 4 to 6 and is driven to prepare an intended mixture.

Figure 11:
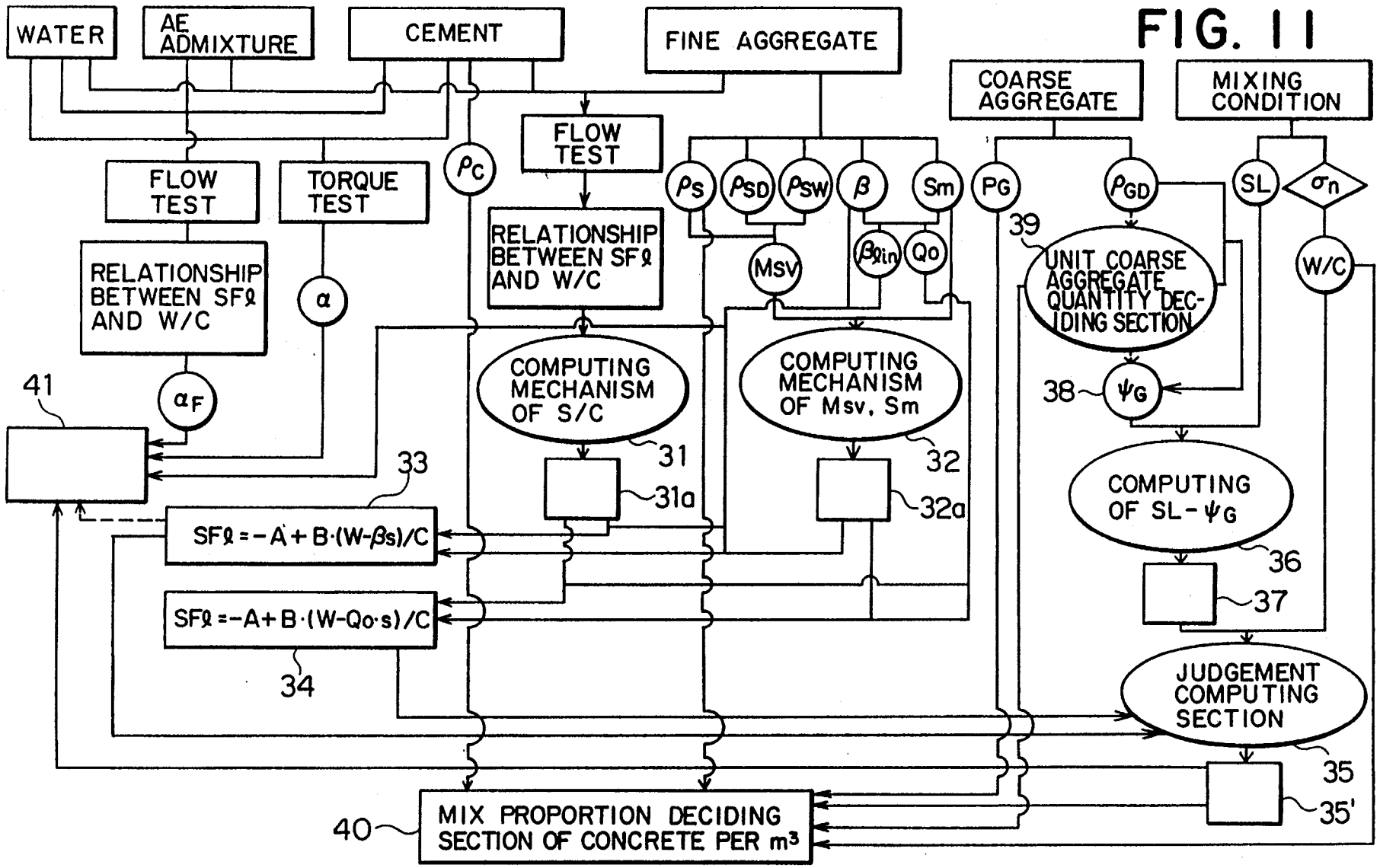
FIG. 11 is an illustrative view showing details of set inputs etc. on a control panel.

The details of set inputs etc. on the control panel 7 are separately shown in FIG. 11. It is apparent that according to the above-described invention, $\alpha$F, percentage holding water ($\alpha$) of grain, true specific gravity ($\rho_c$) of cement, specific gravity in absolute dry condition ($\rho_s$) of fine aggregate, weight per unit volume in absolute dry condition ($\rho_{SD}$) of fine aggregate, underwater weight per unit volume ($\rho_{SW}$) of fine aggregate, percentage of relative retaining water ($\beta$) of fine aggregate, specific surface area (Sm) of fine aggregate, percentage of critical surface adsorbed water ($\beta$lim) of fine aggregate, percentage water absorption according to the present invention ($Q_0$), specific gravity in absolute dry condition ($\rho_G$) of coarse aggregate and weight per unit volume in absolute dry condition ($\rho_{GD}$) of coarse aggregate as shown in the above-described FIG. 4 are input in the above-described setting section 8. These inputs are conducted by directly connecting the measuring mechanism to the control panel 7 and inputting the above data. As described above, the above-described percentage critical surface absorbed water, $\beta$, of the fine aggregate may be one determined on a mixture of the fine aggregate with powder such as cement, or the fine aggregate alone. In order to conduct computation or determination based on the above-described inputs, a computing mechanism 31 of a function of S/C is used wherein the relationship between S/C and W/C and SFl are set and a computing mechanism 32 of a function of the unit weight of fine grain, $M_{SV}$, obtained from inputs of the above-described $\rho_s$, $\rho_{SD}$ and $\rho_{SW}$, and the above-described Sm as shown in FIG. 5. Coefficient deciding sections 31*a* and 32*a* are connected to these mechanisms 31 and 32. The coefficient deciding sections 31*a* and 32*a* are connected to a composite kneading flow value deciding section 33 and a normal kneading flow value deciding section 34. The flow value deciding sections 33 and 34 are connected to a judgement computing section 35. The amount of the primary kneading water ($W_1$) in the composite kneading is determined through utilization of either the percentage of relative retaining water ($\beta$) of the fine aggregate or the percentage of relative critical surface adsorbed water ($\beta$lim). A computing section 36 of a function of W/C as a mixing proportion derived from the slump value, SL, and the intended strength ($\delta_n$) and SL$-\psi_{GD}$ are connected to the judgement computing section 35 through a flow deciding section 37 for mortar. The above-described $\rho_{GD}$ and $\psi_G$ deciding section 38 are connected to the above-described computing section 36 of a function of SL$-\psi_G$. The above-described $\rho_{GD}$ is separately connected to a unit coarse aggregate quantity deciding section 39 and to a unit coarse aggregate quantity deciding section 39 of the above-described $\psi_G$ deciding section 38.

The above-described judgement computing section 35 is provided with an S/C deciding section 35' for determining S/C through the above-described connection, and the S/C deciding section 35' is connected to a mix proportion deciding section 40. A signal from the W/C determined from the above-described described deciding section 39 of unit amount of coarse aggregate and the intended strength is input into the mix proportion deciding section, and the above-described $\rho_G$, $\rho_S$ and $\rho_C$ as well are input thereinto, thereby determining a measuring set value per $m^3$ of the intended concrete. The measuring set value is displayed on the lower part of the display section 17 in the control 7 shown in FIG. 10. The above-described S/C deciding section 35' is connected to a $W_1$/C deciding section 41 for composite kneading into which $\alpha$F, $\alpha$ and $\beta$ are input and the $W_1$/C deciding section 41 is built in the above-described control panel 7.

As described above, the above-described deciding section 39 of unit amount of coarse aggregate determines the unit amount of coarse aggregate based on the optimal s/a or susceptibility to clogging and separation, profitability, etc. and conduct an output to the mix proportion deciding section 40 upon receipt of an output of the $\rho_{GD}$ or $\psi_G$ 38.

As described above, according to the present invention, when a mixture comprising a fine granular material such as sand, powder such as cement and a liquid, and further a concrete comprising the above materials and, mixed therewith, a massive material are prepared, the weight per unit volume, amount of flowable impalpable powder component, percentage of true water absorption, percentage of underwater looseness (percentage packing), amount of retained water and other new factors in an underwater closest packed state are elucidated and these factors are properly adopted to facilitate rational and proper preparation of a mixture through the determination or control of a useful design of mix proportion impossible in the art without using the conventional method necessary to provide many number of steps such as trial kneading and poor accuracy.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A process for preparing a mixture comprising a granular material, a powder, and a liquid, the granular material comprising at least one of sand, a granular slag, and an artificial fine aggregate, the powder comprising at least one of cement, fly ash and powdery slag, and the liquid comprising water, the process comprising the steps of mixing the granular material, the powder and the liquid to prepare a mixture of one of mortar and concrete, preparing an underwater closest packed material by conducting consolidation packing under such an underwater condition that the charging surface of the granular material is allowed to substantially coincide with the liquid surface, the underwater weight per unit volume of the granular material in the underwater closest state being determined and the mix proportion of the mixture being determined based on the underwater weight per unit volume.

2. The process for preparing a mixture as recited in claim 1, further comprising the steps of consolidation packing under absolute dry condition the granular material and determining the weight of a particulate component as the difference between the underwater weight per unit volume of the granular material and the weight per unit volume in absolute dry condition in a closest packed material in absolute dry condition of the granular material subjected to the consolidation packing under absolute dry condition, or weighing the particulate component and determining the volume of flowable particulate component by dividing the weight of the particulate component by the specific gravity of the granular material and determining the mix proportion of the mixture based on at least one of the weight of the flowable particulate component and the volume of the flowable particulate component.

3. The process for preparing a mixture wherein the amount of the flowable particulate component determined in claim 2 is used as a function of the percentage underground looseness ($\psi_{sw}$) which is determined by the following equation of the granular material from the underwater weight per unit volume ($\rho_{sw}$) and determined by the mix proportion of the mixture based on the percentage of underwater looseness:

$$\psi_{sw}=(1-S/\rho_{sw})\times 100$$

wherein S is the amount of the granular material, an amount of flowable water ($W_w$) is determined by the following equation I and the mix proportion of the mixture is predicted and determined according to the equation II:

$$W_w=K\cdot\psi_{sw}^{-k} \quad \text{I}$$

wherein K and k are each a function of the amount of fluid particulate component: and $$W_w=1000-(Cv+\alpha\cdot C+Sv+\beta\cdot S) \quad \text{II}$$

wherein Cv is the weight per unit volume of powder, $\alpha\cdot C$ is the amount of water retained powder, Sv is the weight per unit volume of granular material and $\beta\cdot S$ is the amount of water retained by the granular material.

4. The process for preparing a mixture as recited in claim 1, further comprising the steps of determining an amount of the granular material S and determining by the following equation the percentage of underwater looseness ($\psi_{sw}$) of the granular material from the underwater weight per unit volume ($\rho_{sw}$) and determining the mix proportion of the mixture based on the percentage of underwater looseness:

$$\psi_{sw}=(1-S/\rho_{sw})\times 100$$

wherein S is the amount of the granular material.

5. A process for preparing a mixture comprising a granular material, a powder, and a liquid, the granular material comprising at least one of sand, a granular slag, and an artificial fine aggregate, the powder comprising at least one of cement, fly ash and powdery slag, and the liquid comprising water, the process comprising the steps of mixing the granular material, the powder and the liquid to prepare a mixture of one of mortar and concrete, measuring the fluidity of the mixture on a flow table, determining the mix proportion of the mixture based on one of a spread diameter and a directly measured spread area on the flow table, and determining a flow test valve by preparing a plurality of mortars having a constant granular material to powder mixing ratio with a varied liquid to powder mixing ratio and determining the test values respectively on the mortars, a linear state between the test value and the liquid to powder mixing ratio is determined on a diagram and the mix proportion of the mixture is determined based on the linear state.

6. A process for preparing a mixture comprising a granular material, a powder, and a liquid, the process comprising the steps of conducting a flow test of mortar necessary for preparing one of mortar and concrete which comprises the steps of:

determining a relationship between one of a flow value and a flow area and experimental constants of at least two granular material to powder mixing ratios (S/C) linear equations with reference to a liquid to powder mixing ratio (W/C) by measuring at least two samples having a different granular material to powder mixing ratio (S/C) with a varied liquid to powder mixing ratio (W/C) in the same S/C ratio;

predicting the fluidity in a given mix proportion of the granular material, powder and liquid; and mixing the granular material powder and liquid together.

7. A process for preparing a mixture comprising the steps of providing a granular material, a powder, and a liquid, measuring a relationship between fluidity and granular material to powder ratio (S/C) and liquid to powder ratio (W/C) for preparing one of a mortar and a concrete by measuring the specific surface area (Sm: $cm^2/g$) and particulate component content ($M_{sv}$) of the granular material, determining a linear equation of S/C according to experimental constants as function of the Sm and $M_{sv}$, determining the linear relationship between a flow area in any S/C and W/C, thereby determining the relationship between the flow area (SFl) and the W/C in coordinates, predicting and determining the fluidity and mix proportion of mortar based on the linear relationship and selecting amounts of granular material and powder based on the linear relationship to obtain a desired mortar.

8. The process for preparing a mixture according to claim 7 further comprising the steps of mixing the granular material, the powder and the liquid to prepare a mixture of one of mortar and concrete, draining treating the mixture by a predetermined force such that substantially no decrease in residual liquid content is observed even by increasing draining energy on a plurality of mixture with the ratio of the specific area of the granular material to the powder being varied, an intersection of a generally straight line formed by the percentage of relative critical adsorbed water in a diagram of cartesian coordinates expressed in terms of the relationship with the specific surface area and the residual liquid content wherein the residual liquid content proportionally increases with a variation in the specific surface area of the granular material, and the zero axis of the specific surface area are determined as a true water absorption of the granular material, and the mix proportion of the mixture being determined based on the water adsorption.

9. The process for preparing a mixture according to claim 7, wherein the process comprises a primary kneading step and a secondary kneading step, part of the mixing water being added for the secondary kneading step, thereby preparing an intended kneaded product, wherein an amount of water for the primary kneading step is determine through one of a percentage of relative retaining water and a percentage relative critical surface adsorbed water of the granular material.

10. A process for preparing a mixture comprising a granular material, a powder, and a liquid, the granular material comprising at least one of sand, a granular slag, and an artificial fine aggregate, the powder comprising at least one of cement, fly ash and powdery slag, and the liquid comprising water, the process comprising the steps of mixing the granular material, the powder and the liquid to prepare a mixture of one of mortar and concrete, draining treating the mixture by a predetermined force such that substantially no decrease in residual liquid content is observed even by increasing draining energy on a plurality of mixture with the ratio of the specific area of the granular material to the powder being varied, an intersection of a generally straight line formed by the percentage of relative critical adsorbed water in a diagram of cartesian coordinates expressed in terms of the relationship with the specific surface area and the residual liquid content wherein the residual liquid content proportionally increases with a variation in the specific surface area of the granular material, and the zero axis of the specific surface area are determined as a true water absorption of the granular material, and the mix proportion of the mixture is determined based on the water adsorption.

11. A process for preparing a concrete comprising the steps of:

mixing a granular material, a powder, a coarse aggregate and a liquid, the granular material comprising at least one of sand, a granular slag, an artificial fine aggregate, the powder comprising at least one of cement, fly ash or powdery slag, the coarse aggregate comprising gravel and the liquid comprising water;

determining the flow value of a mortar from the slump value required for the concrete and the void ratio of the coarse aggregate assembly; and determining the mix proportion based on a liquid to powder ratio (W/C) derived from the flow value and the strength of the concrete.

12. An apparatus for preparing a mixture comprising a granular material, a powder, and a liquid, the apparatus comprises a cement measuring hopper, a measuring hopper for the granular material, a water measuring tank and a control panel for inputting an output signal from a sensor provided in the hoppers and measuring tank, said control panel being provided with a computing mechanism for computing a relationship between weight of a flowable particulate component or volume of the flowable particulate component and the specific surface area of the granular material and a coefficient deciding section connected to the computing mechanism.

13. An apparatus for preparing a mixture comprising a granular material, a powder, and a liquid, the apparatus comprises a cement measuring hopper, a measuring hopper for the granular material, a coarse aggregate measuring hopper, a water measuring tank and a control panel for inputting an output signal from a sensor provided in the hoppers and measuring tank, said control panel being provided with input means for a water to cement ratio (W/C) determined from a slump value and strength as the mixing condition in an intended mixture, and a void ratio of the coarse aggregate, a computing mechanism for computing the slump value and the void ratio of the coarse aggregate, a flow value deciding section for mortar connected to the computing mechanism, and a judgement computing section and a mixing proportion deciding section for concrete.

* * * * *